US009207620B2

(12) United States Patent
Okumura et al.

(10) Patent No.: US 9,207,620 B2
(45) Date of Patent: Dec. 8, 2015

(54) COMBINED UNITS AND IMAGE FORMING SYSTEM

(71) Applicant: KYOCERA Document Solutions Inc., Osaka (JP)

(72) Inventors: Keiji Okumura, Osaka (JP); Terumitsu Noso, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/214,015

(22) Filed: Mar. 14, 2014

(65) Prior Publication Data

US 2014/0270837 A1 Sep. 18, 2014

(30) Foreign Application Priority Data

Mar. 18, 2013 (JP) ..... 2013-054770
Jul. 24, 2013 (JP) ..... 2013-153722

(51) Int. Cl.
*G03G 15/00* (2006.01)
*G03G 21/16* (2006.01)

(52) U.S. Cl.
CPC ..... *G03G 15/80* (2013.01); *G03G 21/1652* (2013.01); *G03G 2221/1696* (2013.01)

(58) Field of Classification Search
CPC ..... G03G 21/1652; G03G 21/16; G03G 21/1642; G03G 15/1604; G03G 15/80
See application file for complete search history.

(56) References Cited

U.S. PATENT DOCUMENTS 7,731,524 B2 * 6/2010 Dittus et al. ..... 439/533
2004/0208669 A1 * 10/2004 Tokishige et al. ..... 399/107
2006/0248733 A1 * 11/2006 Masai ..... 30/377

FOREIGN PATENT DOCUMENTS

JP 07-295319 A 11/1995
JP 2008-046535 2/2008

OTHER PUBLICATIONS

The extended European search report mailed by European Patent Office on Jan. 30, 2015 in the corresponding European patent application No. 14159789.8—7 pages.

* cited by examiner

*Primary Examiner* — Clayton E Laballe
*Assistant Examiner* — Ruifeng Pu
(74) *Attorney, Agent, or Firm* — Knobbe, Martens, Olson & Bear LLP

(57) ABSTRACT

An image forming system includes an image forming apparatus, a post-processing apparatus, a fixed member, a first connector, a connecting member, and a second connector. The mage forming apparatus includes the fixed member on which the first connector is mounted and the post-processing apparatus includes connecting member on which the second connector is mounted. The connecting member is movable in a front-back direction and configured so as to be displaced between an engaging position in which the connecting member is engaged with the fixed member and a disengaging position in which the connecting member is disengaged from the fixed member. The first connector and the second connector are disconnected from each other when the connecting member is set to the disengaging position, and connected to each other when the connecting member is set to the engaging position.

10 Claims, 23 Drawing Sheets

COMBINED UNITS AND IMAGE FORMING SYSTEM

INCORPORATION BY REFERENCE

This application claims priority to Japanese Patent Application No. 2013-153722 filed on Jul. 24, 2013, and Japanese Patent Application No. 2013-54770 filed on Mar. 18, 2013, the entire contents of which are incorporated by reference herein.

BACKGROUND

The present disclosure relates to combined units including two units electrically connected to each other via a connector, and to an image forming system.

Various combined units are known that include two units located side by side and mechanically connected to each other, and also electrically connected via a connector to supply power to both units and to establish electrical communication therebetween. In the field of image forming, for example, the combined units may be composed of the main body of an image forming apparatus and a post-processing apparatus optionally connected to the main body.

To electrically connect the main body of the image forming apparatus and the post-processing apparatus, the connectors of the respective apparatuses may be connected to each other via a cable having connectors on both ends, after mechanically connecting the apparatuses. In this case, however, the connection work of the cable has to be performed behind the apparatuses, which degrades the work efficiency. In addition, such an appearance that the cable having an inevitable extra length is hanging down between the apparatuses looks awkward to users. The cable may first be connected and the extra length portion of the cable may be placed inside either apparatus, before mechanically connecting the apparatuses. However, the cable may be damaged by a contact with a frame member installed in the apparatus when the extra length portion is being set in the apparatus. Besides, the connection work is difficult to perform since the work has to be done inside a narrow space. Further, in the case of employing a cable for connection as above, if the post-processing apparatus is moved, after mechanically disconnecting the post-processing apparatus from the main body, away from the main body without disconnecting the cable, the cable and/or the connector may be damaged.

On the other hand, a drawer connector may be provided on each of the apparatuses, so that the drawer connectors may be fitted to each other for electrical connection when the post-processing apparatus is mounted at a predetermined position of the main body, and the apparatuses may be mechanically connected thereafter. Such an arrangement eliminates the foregoing drawbacks incidental to the use of the cable, and improves the work efficiency. However, basically, both the electrical connection between the apparatuses via the drawer connectors and the mechanical connection still have to be performed, and hence there is a room for further improvement in work efficiency.

Furthermore, in an environment where the main body and the post-processing apparatus are different in height level, the drawer connectors are also deviated in height level from each other, which makes it difficult to properly fit the drawer connectors for connection. The difference in height level may be produced, for example, when a heavy-weighted main body sinks into a carpet on the floor. In such a case, the drawer connectors may be damaged upon attempting to forcibly fit the drawer connectors to each other. Further, even though the connection of the drawer connectors is achieved, stress may remain at the fitting position, which may make the contact between the pins of the respective connectors unstable, thereby provoking a communication error.

SUMMARY

In an aspect, the disclosure proposes further improvement of the foregoing technique.

The disclosure provides combined units including a first unit, a second unit, a fixed member, a first connector, a connecting member, and a second connector.

The first unit has a first side face, and includes therein a first electric device.

The second unit has a second side face and includes therein a second electric device, the second unit being installed beside the first unit, with the second side face opposed to the first side face.

The fixed member is disposed on the first side face in a fixed manner.

The first connector is disposed on the first side face in a fixed manner and electrically connected to the first electric device.

The connecting member is disposed on the second side face so as to move in a second direction orthogonal in a horizontal plane to a first direction in which the first unit and the second unit are aligned, and is configured so as to be displaced between an engaging position in which the connecting member is engaged with the fixed member and a disengaging position in which the connecting member is disengaged from the fixed member.

The second connector is connectable to the first connector, mounted on the connecting member, and electrically connected to the second electric device.

The first connector and the second connector are disconnected from each other when the connecting member is set to the disengaging position, and the first connector and the second connector are connected to each other when the connecting member is set to the engaging position.

In another aspect, the disclosure provides an image forming system including an image forming apparatus, a post-processing apparatus, a fixed member, a first connector, a connecting member, and a second connector.

The image forming apparatus includes a first side face, and is configured to form an image on a sheet using a first electric device included in the image forming apparatus.

The post-processing apparatus includes a second side face and includes therein a second electric device that performs a predetermined post processing on the sheet on which the image has been formed, the post-processing apparatus being configured to perform the post processing upon being installed beside the image forming apparatus with the second side face closely opposed to the first side face.

The connecting member is disposed on the second side face so as to move in a second direction orthogonal in a horizontal plane to a first direction in which the image forming apparatus and the post-processing apparatus are aligned, and is configured so as to be displaced between an engaging position in which the connecting member is engaged with the fixed member and a disengaging position in which the connecting member is disengaged from the fixed member.

In the image forming apparatus, the first connector and the second connector are disconnected from each other when the connecting member is set to the disengaging position, and the first connector and the second connector are connected to each other when the connecting member is set to the engaging position.

DETAILED DESCRIPTION

First Embodiment

Figure 1:
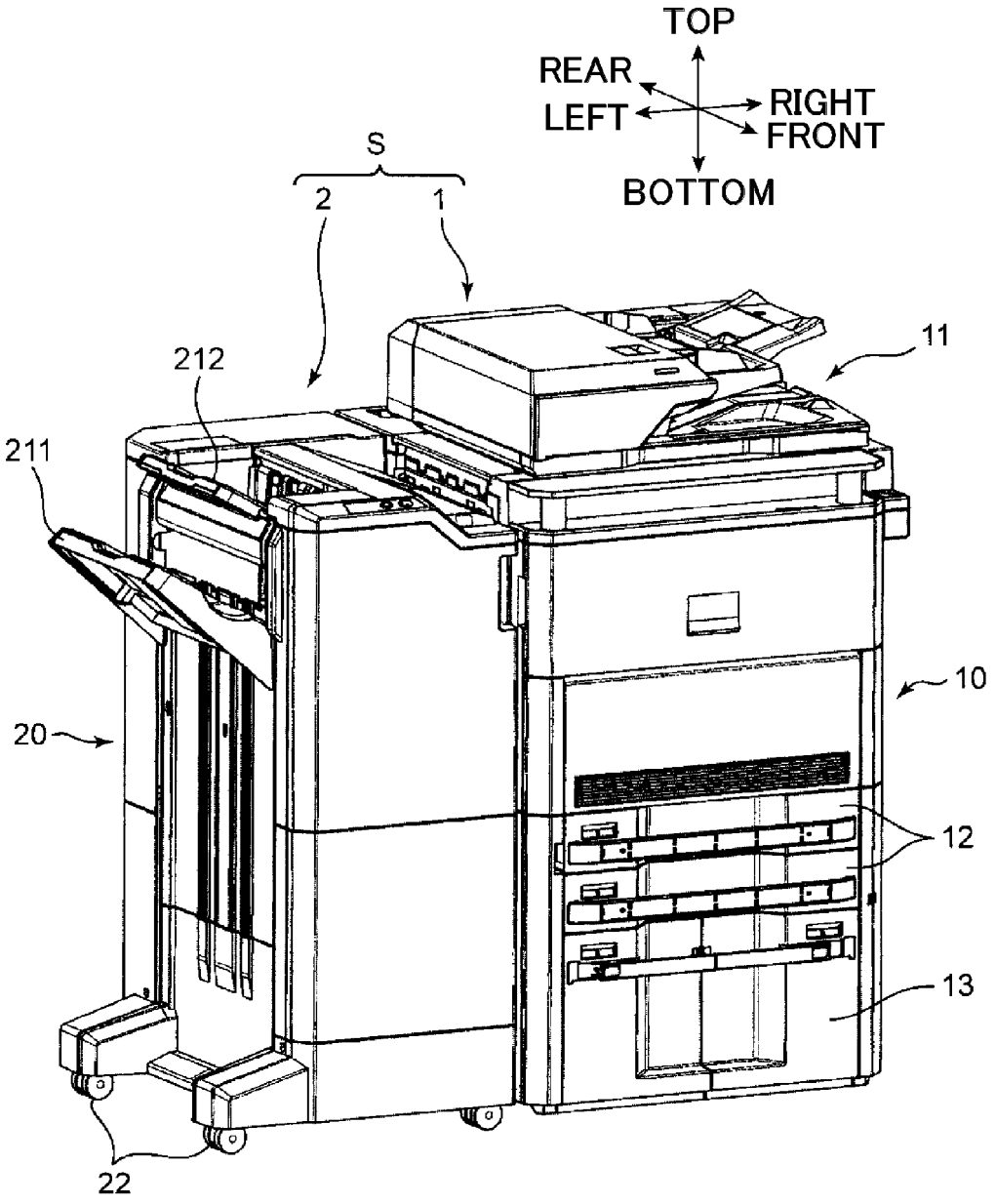
FIG. 1 is a perspective view showing an image forming system according to a first embodiment of the disclosure, including an image forming apparatus and a post-processing apparatus.
Figure 2:
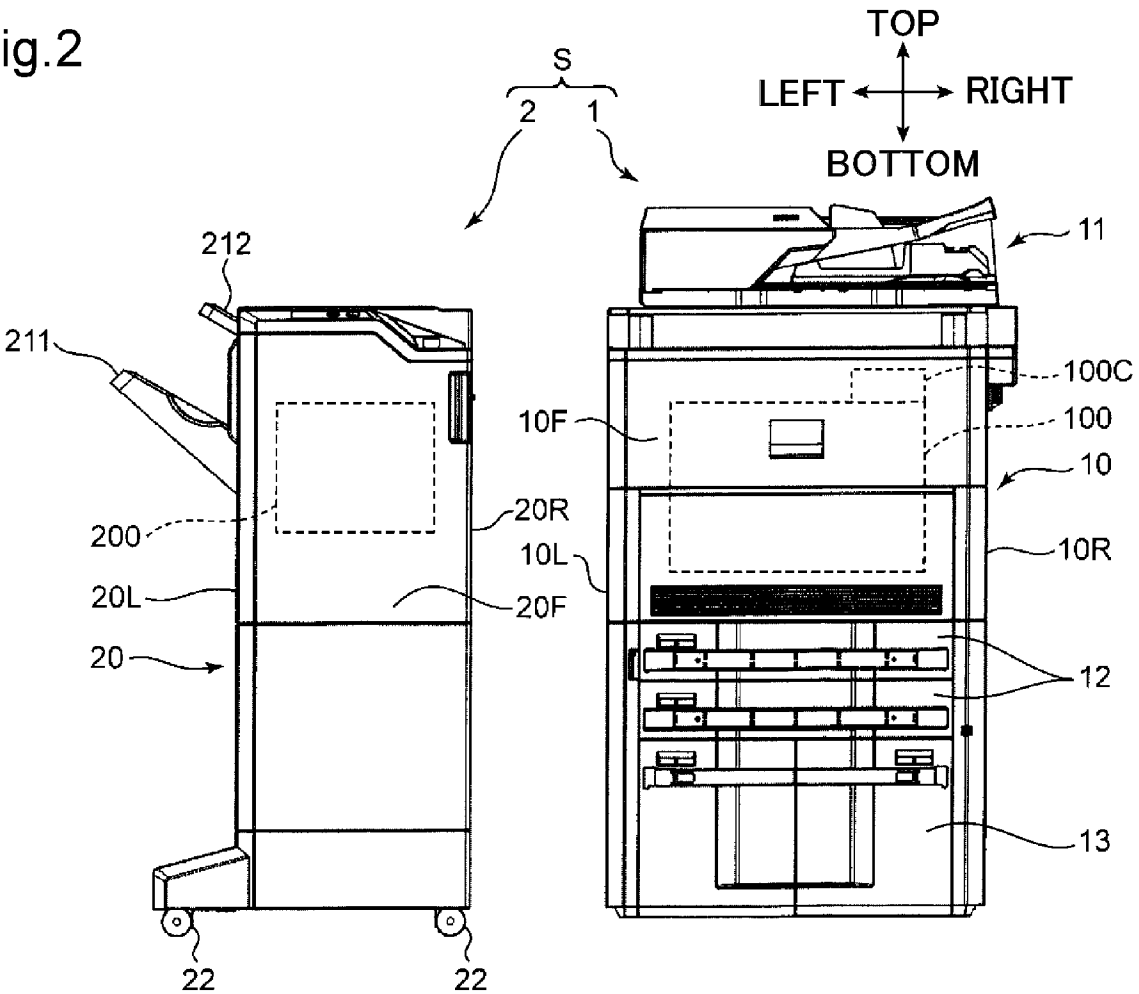
FIG. 2 is a front view showing the image forming apparatus and the post-processing apparatus, separated from each other.

Hereafter, embodiments of the disclosure will be described in details with reference to the drawings. FIG. 1 is a perspective view showing an image forming system S (combined units) according to a first embodiment of the disclosure. The image forming system S is composed of combined units including an image forming apparatus 1 (first unit) that forms an image on a sheet and a post-processing apparatus 2 (second unit) installed on the left of the image forming apparatus 1. The post-processing apparatus 2 is added to the image forming apparatus 1 as an optional unit. FIG. 2 illustrates the image forming apparatus 1 and the post-processing apparatus 2 separated from each other.

The image forming apparatus 1 is a full-color copier that optically reads an image on an original sheet and forms a full-color image on a sheet according to image data. Here, the image forming apparatus 1 may be a monochrome copier, a printer, a facsimile machine, or a multifunction peripheral having the functions of the cited machines. The image forming apparatus 1 includes a main housing 10 and an automatic document feeder (hereinafter, ADF) 11 located on top of the main housing 10. Two stages of paper feed cassettes 12 of an ordinary capacity are mounted in a lower section of the main housing 10, and a paper feed cassette 13 of a large capacity is mounted under the paper feed cassettes 12. In each of the paper feed cassettes 12, 13, a bundle of sheets on which the image is to be formed are placed.

The main housing 10 is of a rectangular block shape having a left side face 10L (first side face), a right side face 10R, a front face 10F and a rear face (unseen in FIGS. 1 and 2). The main housing 10 includes therein an imaging unit 100 (part of the first electric device) that executes the image forming process, and a control unit 100C (part of the first electric device) that controls the operation of the image forming system S. The imaging unit 100, which serves to generate a toner image, and to transfer and fix the toner image onto the sheet, includes an image forming unit and a fixing unit. The image forming unit includes a photoconductor drum, and a charging unit, an exposure unit, a developing unit, a transfer roller, and a cleaning unit located in the vicinity of the photoconductor drum.

A static latent image and a toner image are formed on the outer circumferential surface of the photoconductor drum. The charging unit uniformly charges the outer circumferential surface of the photoconductor drum. The exposure unit includes a laser source and optical components such as a mirror and a lens, and irradiates the outer circumferential surface of the photoconductor drum with a laser beam to thereby form a static latent image. The developing unit supplies a toner to the outer circumferential surface of the photoconductor drum to thereby develop the static latent image. Here, the toner is supplied to the developing unit from a toner container. The transfer roller forms a transfer nip region in collaboration with the photoconductor drum. The sheet passing through the transfer nip region is subjected to a transfer bias, so that the toner image on the photoconductor drum is transferred onto the sheet. The cleaning unit includes a cleaning roller, with which the outer circumferential surface of the photoconductor drum is cleaned after the toner image is transferred.

The fixing unit serves to fix the toner image transferred onto the sheet. The fixing unit includes a heat roller having heater located therein, and a pressure roller pressed against the heat roller. When the sheet carrying the toner image transferred thereto passes the fixing nip formed between the heat roller and the pressure roller, the toner is heated and molten, and the toner image is fixed on the sheet. The sheet that has undergone the fixing process is delivered into the post-processing apparatus 2.

The control unit 100C is constituted of a microcomputer including a read only memory (ROM) containing various control programs and a random access memory (RAM) that temporarily stores data related to computing and controlling operations, and serves to control the operation of the image forming apparatus 1. When the post-processing apparatus 2 is added to the image forming apparatus 1 and connected thereto by fitting (coupling) a first connector 4 with a second connector 6, the control unit 100C also controls the operation of the post-processing apparatus 2.

The ADF 11 automatically feeds the original sheet to be copied, to a predetermined document reading position. Although not shown, a manual setting contact glass and an automatic reading contact glass are mounted on top of the main housing 10, and the ADF 11 transports the original sheet via the latter one. A non-illustrated image reading unit is installed right under those contact glasses.

The post-processing apparatus 2 performs a predetermined post processing on the sheet or a bundle of sheets that have undergone the image forming process in the image forming apparatus 1. Examples of the post processing include punching for forming a binding hole in the sheet, stapling for binding a bundle of sheets with a staple, folding the sheet, and alignment of the sheet including shifting and width matching.

The post-processing apparatus 2 includes a main housing 20. The main housing 20 is of a rectangular block shape having a left side face 20L, a right side face 20R (second side face), a front face 20F, and a rear face (unseen in FIGS. 1 and 2). When the post-processing apparatus 2 is placed beside the image forming apparatus 1, the right side face 20R of the post-processing apparatus 2 and the left side face 10L of the image forming apparatus 1 are opposed to each other. The main housing 20 includes therein a post processing unit 200 (second electric device) including a punching blade and a drive mechanism therefor, a stapler, an alignment mechanism for the sheet, a sheet transport route and sheet transport rollers.

A first tray 211 on which the sheet that has undergone one of the post processings is outputted is provided on the left side face 20L of the main housing 20, and a second tray 212 on which the sheet that has skipped the post processing is mainly outputted is provided on the upper face of the main housing 20. The first tray 211 is movable in an up-down direction. Casters 22 for transport are attached to the lower face of the main housing 20.

The post-processing apparatus 2 is additionally combined with the image forming apparatus 1 already installed. Upon being combined, the post-processing apparatus 2 is both mechanically and electrically connected to the image forming apparatus 1. To be more detailed, the post-processing apparatus 2 is moved to the right from the separated position shown in FIG. 2 so that the left side face 10L and the right side face 20R are closely opposed to each other, and the post-processing apparatus 2 and the image forming apparatus 1 are mechanically connected together so as not to separate from each other in a left-right direction. In addition to the mechanical connection, the post-processing apparatus 2 is electrically connected to the image forming apparatus 1, for electrical communication with the control unit 100C. Conversely, when a maintenance work is to be performed or when the sheet is jammed between the apparatuses, both the mechanical connection and the electrical connection are cancelled, and the post-processing apparatus 2 is separated from the image forming apparatus 1. To facilitate and ensure such mechanical connection and the electrical connection, as well as the cancellation thereof, the image forming system S according to this embodiment includes, as shown in FIGS. 3 to 16, a fixed member 3 and a first connector 4 provided on the side of the image forming apparatus 1, and a connecting member 5 and a second connector 6 provided on the side of the post-processing apparatus 2. The detailed configuration and workings of these constituents will be described hereunder.

Figure 3:
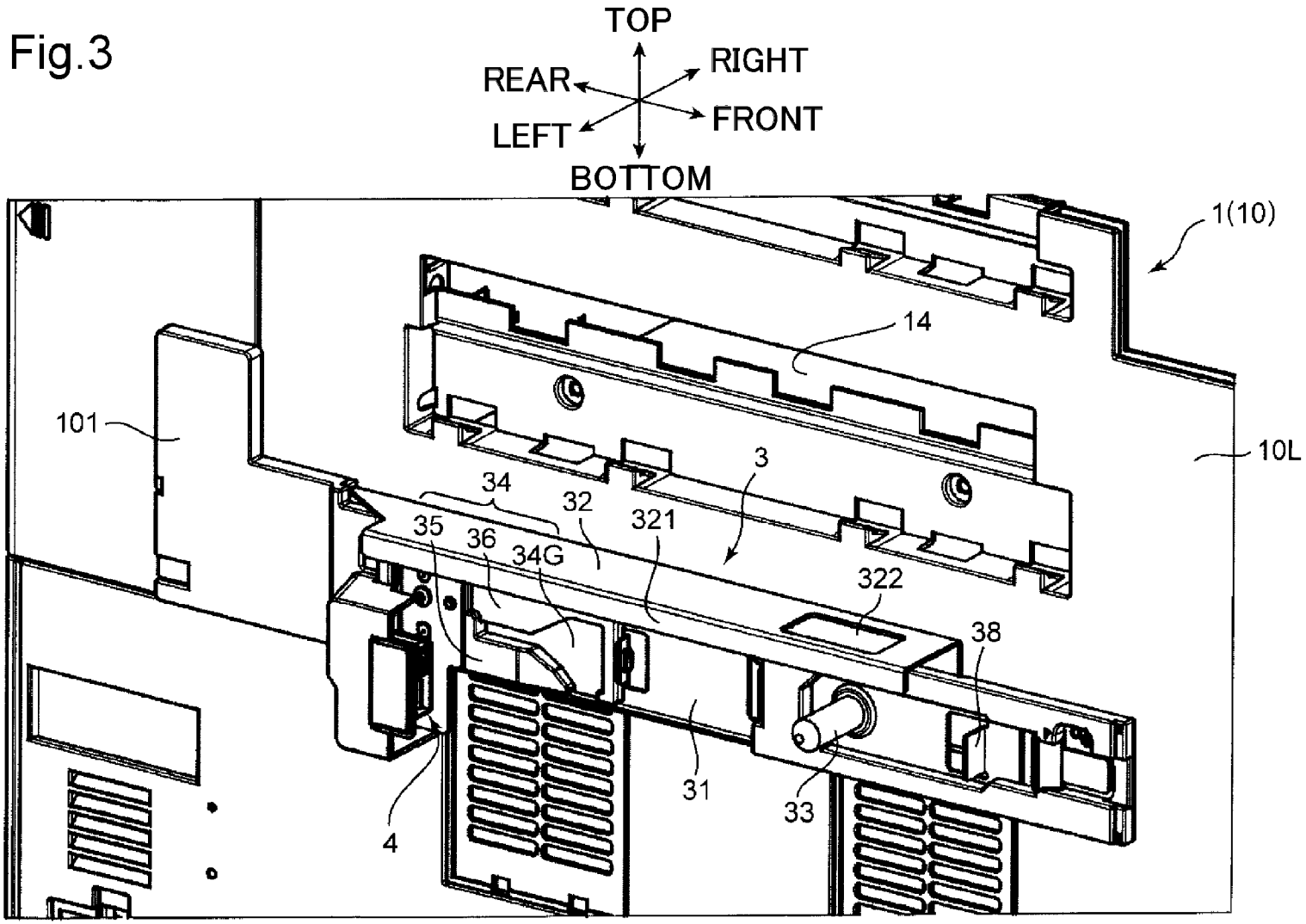
FIG. 3 is a fragmentary perspective view showing a fixed member attached to the left side face the image forming apparatus according to the first embodiment.
Figure 4:
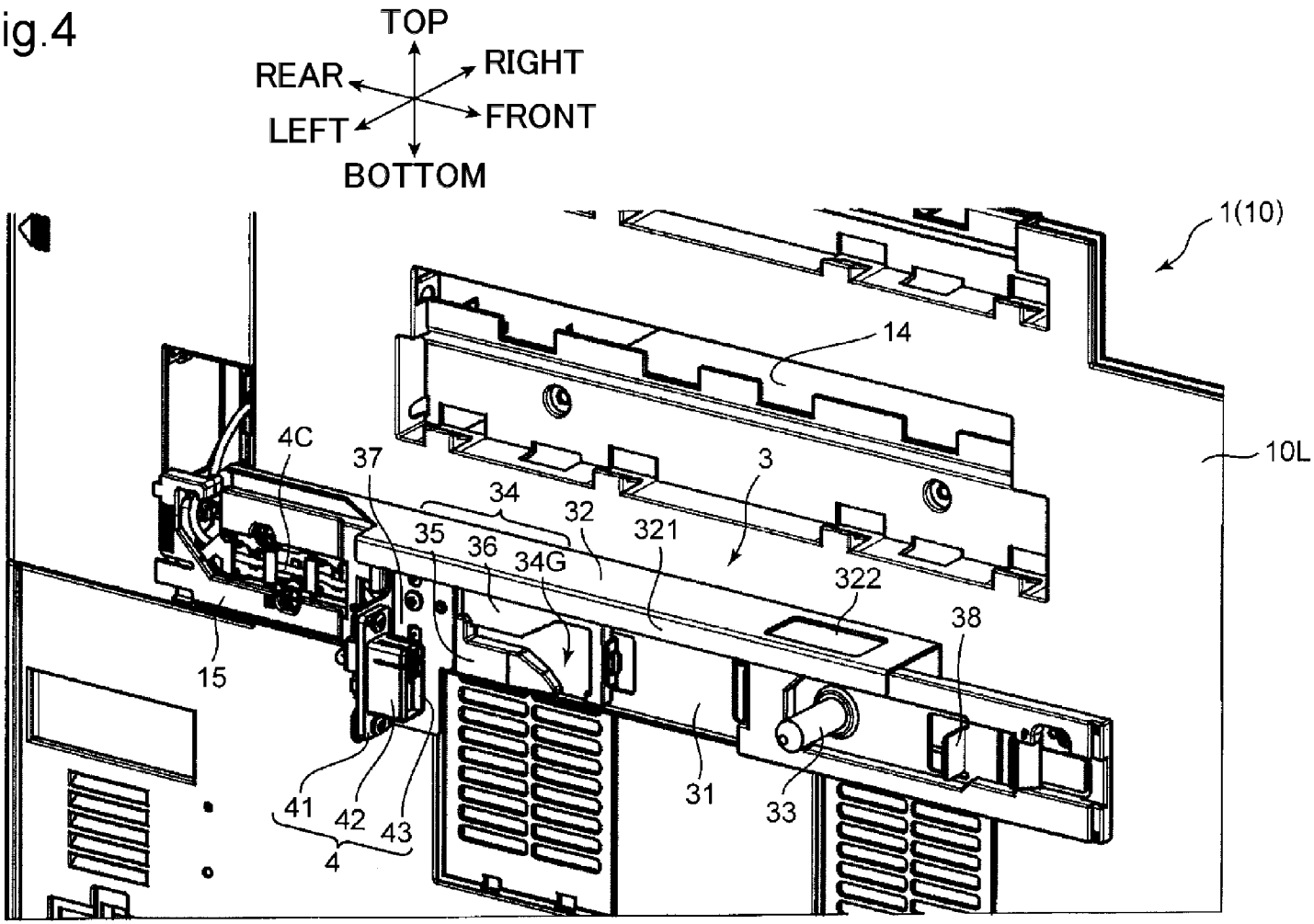
FIG. 4 is a fragmentary perspective view showing the fixed member and a first connector.

FIG. 3 is a fragmentary perspective view showing the fixed member 3 attached to the left side face 10L of the image forming apparatus 1, and FIG. 4 is a fragmentary perspective view showing the first connector 4 exposed by removing a cover 101 from the state shown in FIG. 3. The left side face 10L of the image forming apparatus 1 includes a sheet outlet 14 through which the sheet is delivered to the post-processing apparatus 2. The fixed member 3 is fixed to the left side face 10L at a position below the sheet outlet 14.

The fixed member 3 is formed by bending a metal plate, and includes a flat vertical plate portion 31 extending in a front-back direction, and a flat horizontal plate portion 32 bent to the left from the upper edge of the vertical plate portion 31 and extending in the front-back direction. The vertical plate portion 31 is fixed to a frame member constituting the left side face 10L with a non-illustrated screw, and thus the fixed member 3 is fixed to the side face 10L. The fixed member 3 also includes a lock portion 321 bent vertically downward from the left edge of the horizontal plate portion 32, formed so as to interfere with a connecting member 5 to be subsequently described.

A positioning pin 33 and a guide unit 34 are provided on the left face of the vertical plate portion 31. The positioning pin 33 is a circular column-shaped member laterally projecting in a first direction (in this embodiment, to the left) from the vertical plate portion 31, and having a tapered tip portion. The positioning pin 33 is to be inserted in a long hole 243 (described later) of the post-processing apparatus 2, for positioning between the image forming apparatus 1 and the post-processing apparatus 2 in the front-back direction. The horizontal plate portion 32 includes a rectangular opening 322 formed right above the positioning pin 33, to facilitate the user to visually recognize the positioning pin 33 when performing the positioning. Upon inserting the positioning pin 33 in the long hole 243, the centerline of the sheet in the transport direction from the image forming apparatus 1 toward the post-processing apparatus 2 is defined.

Figure 5:
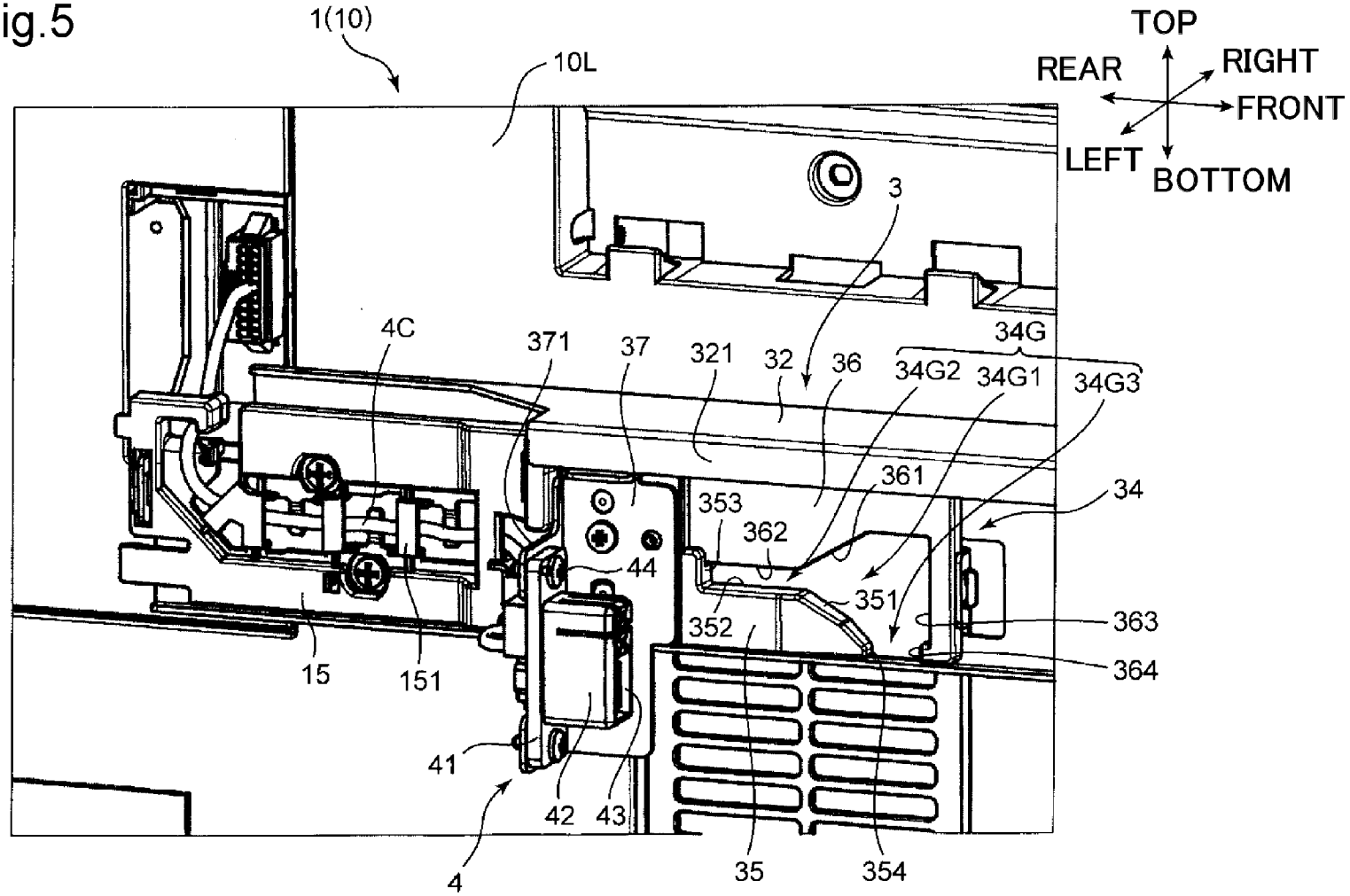
FIG. 5 is an enlarged fragmentary perspective view showing the first connector and a guide unit of the fixed member.

The guide unit 34 extends in the front-back direction with respect to the image forming apparatus 1 (second direction), and serves to guide the second connector 6 to a position where the second connector 6 is fitted with the first connector 4. FIG. 5 is an enlarged fragmentary perspective view showing the first connector 4 and the guide unit 34 of the fixed member 3. The guide unit 34 includes a lower guide member 35, an upper guide member 36, and a guide space 34G defined between the guide members 35, 36.

The lower guide member 35 includes a sloped surface 351 (guide surface) inclined upward toward the rear side, a lower horizontal surface 352 continuously extending from the rear end of the sloped surface 351, and an abutment surface 353 erected upright from the rear end of the lower horizontal surface 352. The upper guide member 36 includes a sloped surface 361 (guide surface) inclined downward toward the rear side, an upper horizontal surface 362 continuously extending from the rear end of the sloped surface 361, and a vertical surface 363 erected upright in the front end portion of the upper guide member 36. The upwardly sloped surface 351 and the downwardly sloped surface 361 oppose each other, so as to define a tapered guide space 34G1 having a width reducing toward the rear side, i.e., in the direction to guide the second connector 6 to the fitting position. The lower horizontal surface 352 and the upper horizontal surface 362 parallelly oppose each other with a predetermined gap therebetween (slightly wider than the diameter of a guide pin 564 to be subsequently described). The front end 354 of the sloped surface 351 and the lower end 364 of the vertical surface 363 oppose each other with a predetermined gap therebetween, at the same height level.

The guide space 34G includes the tapered guide space 34G1 defined between the sloped surfaces 351, 361 and having a width reducing toward the rear side, a slit-shaped space 34G2 continuously extending between the lower horizontal surface 352 and the upper horizontal surface 362 from the rear end of the tapered guide space 34G1, and an introduction space 34G3 defined between the front end 354 and the lower end 364.

The first connector 4 is a drawer connector including a base member 41 having a rectangular plate shape and extending in the up-down direction, a connector housing 42 projecting forward from the base member 41 and including a plurality of connector pins, and a connector opening 43 located in the front end face of the connector housing 42, in which the second connector 6 is to be fitted. An end portion of a first cable 4C is connected to the first connector 4. The first cable 4C is a communication cable, the other end portion of which is electrically connected to a circuit board constituting the control unit 100C in the main housing 10. The first cable 4C is routed from the rear face of the first connector 4 into the main housing 10 along a wiring guide 15, and fastened with cable fasteners 151. Here, the surface of the wiring guide 15 and the left face of the first connector 4 are normally covered with the cover 101.

The first connector 4 is attached to the left side face 10L of the main housing 10. More precisely, the first connector 4 is attached to the fixed member 3 via a mounting plate 37. The mounting plate 37 is a flat plate fixed over the vertical plate portion 31 of the fixed member 3, and includes a bracket 371 erected from the rear edge of the mounting plate 37. The base member 41 of the first connector 4 is fixed to the bracket 371 with a screw 44. Thus, the first connector 4 is immovably attached to a portion of the fixed member 3 in the vicinity of the rear end portion thereof, with the connector opening 43 oriented forward.

Figure 6:
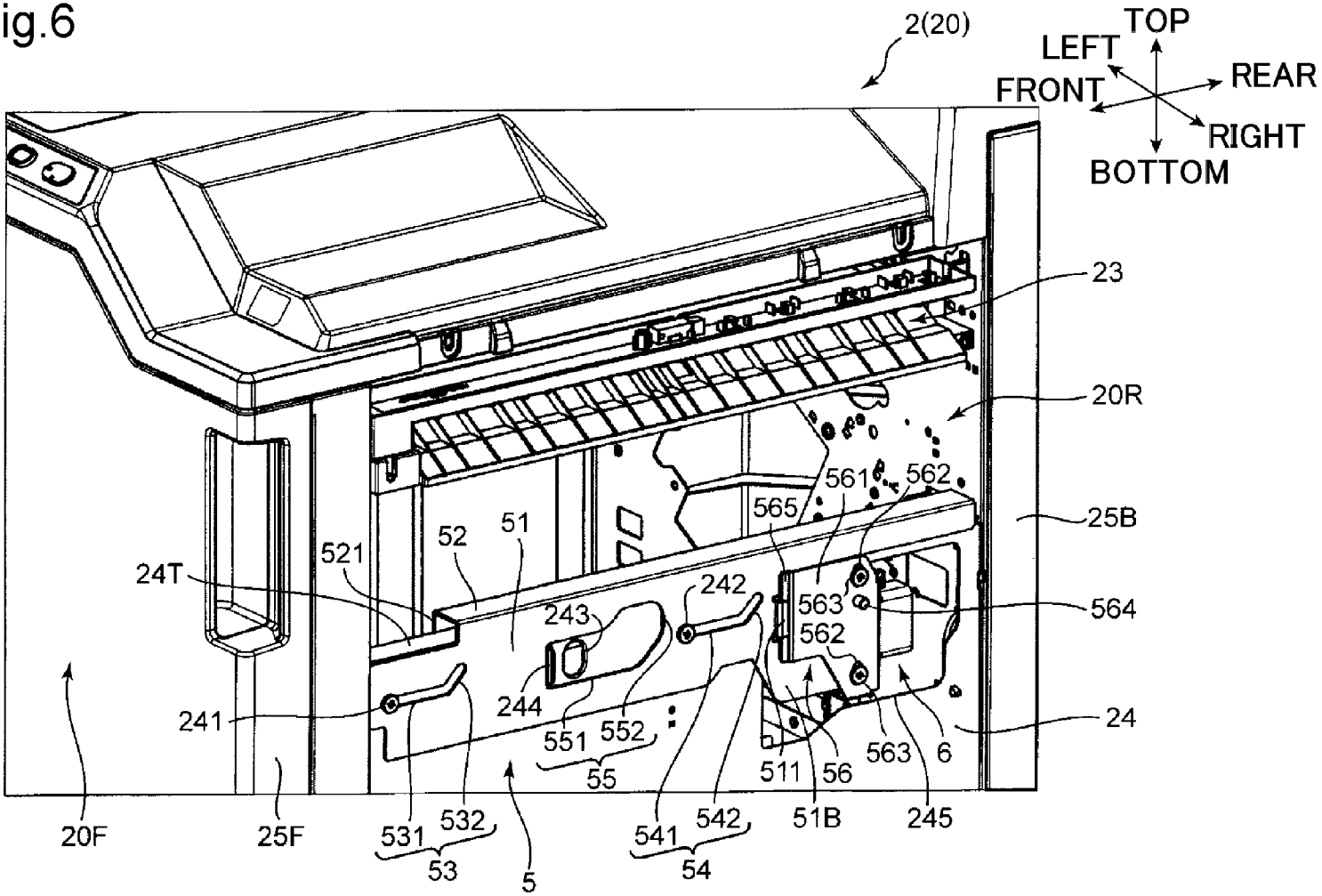
FIG. 6 is a fragmentary perspective view showing a connecting member according to the first embodiment, attached to the right side face of the post-processing apparatus and set to an engaging position.
Figure 7:
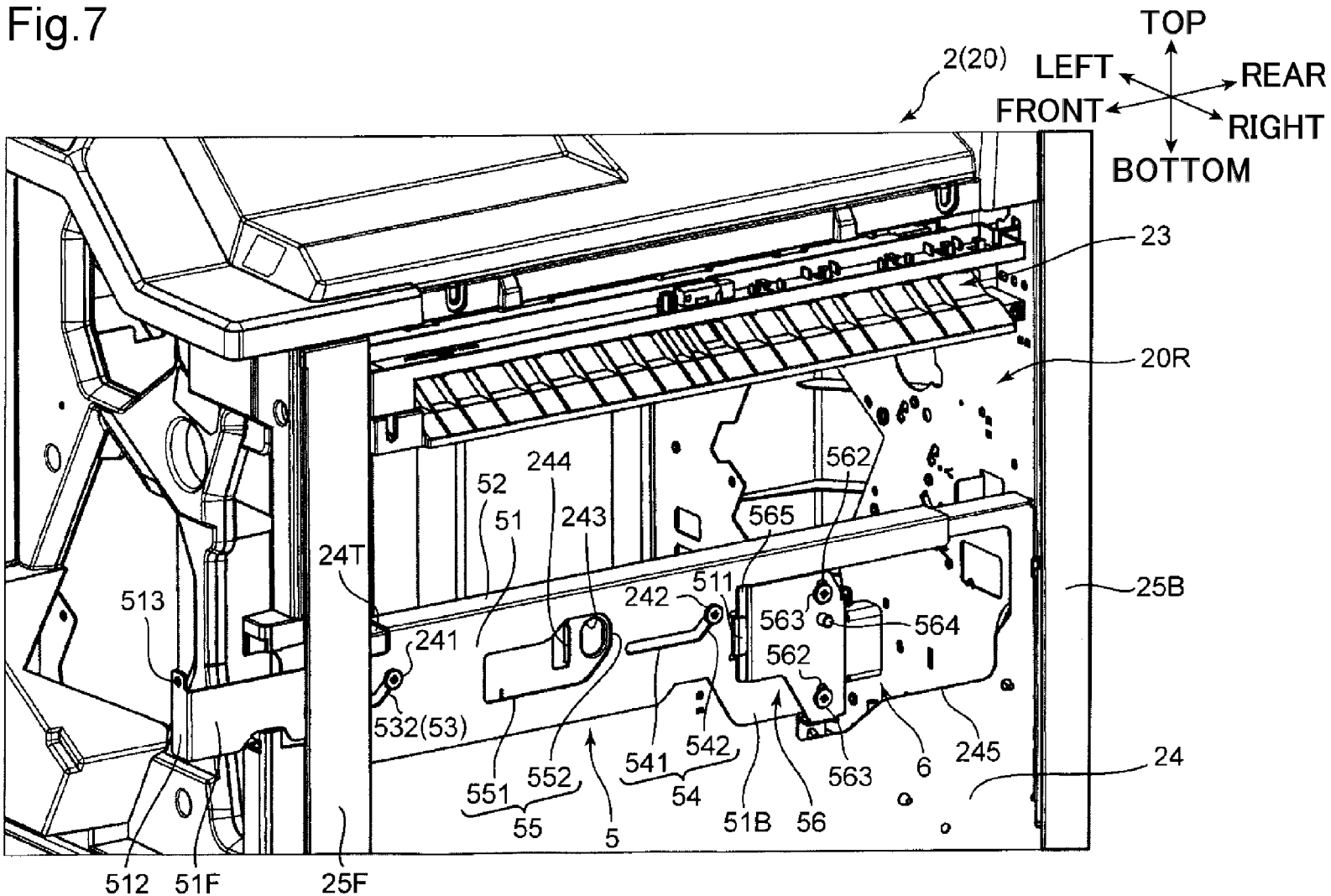
FIG. 7 is a fragmentary perspective view showing the connecting member set to a disengaging position.

FIGS. 6 and 7 are fragmentary perspective views showing the connecting member 5 attached to the right side face 20R of the post-processing apparatus 2. The connecting member 5 is movable in the front-back direction (second direction) orthogonal in a horizontal plane to the direction in which the image forming apparatus 1 and the post-processing apparatus 2 are aligned (left-right direction, i.e., first direction), as well as in the up-down direction (third direction) orthogonal to the aligning direction in a vertical plane. The connecting member 5 serves to mechanically connect the image forming apparatus 1 and the post-processing apparatus 2 so as not to be separated from each other in the left-right direction, by being engaged with the fixed member 3. In other words, the connecting member 5 can be displaced between an engaging position in which the connecting member 5 is engaged with the fixed member 3 and a disengaging position in which those members are disengaged from each other. FIG. 6 illustrates the connecting member 5 in the engaging position, and FIG. 7 illustrates the connecting member 5 in the disengaging position.

The right side face 20R of the post-processing apparatus 2 includes a front vertical frame 25F and a rear vertical frame 25B extending in the up-down direction and located with a clearance therebetween in the front-back direction. A sheet inlet 23 for receiving the sheet discharged from the sheet outlet 14 in the left side face 10L of the image forming apparatus 1 is provided between the front vertical frame 25F and the rear vertical frame 25B at a position close to the upper end portion of the vertical frames 25F, 25B. A vertical frame plate 24 (frame member) is spanned between the front vertical frame 25F and the rear vertical frame 25B in a region under the sheet inlet 23. The connecting member 5 is attached to the vertical frame plate 24 at a position close to the upper edge 24T thereof, so as be displaced with respect to the vertical frame plate 24 both in the front-back direction and in the up-down direction.

The connecting member 5 is formed by bending a metal plate, and includes a flat vertical plate portion 51 extending in the front-back direction, and a flat top plate 52 bent to the left from the upper end of the vertical plate portion 51 and extending in the front-back direction. The connecting member 5 also includes a hanging plate 521 bent vertically downward from the left edge of the top plate 52 so as to interfere with the lock portion 321 of the fixed member 3.

The vertical plate portion 51 includes three openings, which are a first guide opening 53 and a second guide opening 54 aligned in the front-back direction with a spacing therebetween, and a window 55 formed between the guide openings 53, 54. The first guide opening 53 has an elongate shape extending in the front-back direction, and includes a horizontal portion 531 and a sloped portion 532 obliquely extending backward from the rear end of the horizontal portion 531 at an upward angle of approximately 30 degrees. A first guide screw 241 is fastened to the vertical frame plate 24 through the first guide opening 53. The head of the first guide screw 241 is larger than the width of the first guide opening 53 in the up-down direction, and the stem of the first guide screw 241 has a diameter smaller than the opening width. The distance between the head of the first guide screw 241 and the vertical frame plate 24 is larger than the plate thickness of the vertical plate portion 51.

The second guide opening 54 has the same shape as that of the first guide opening 53. The second guide opening 54 includes a horizontal portion 541 and a sloped portion 542, and a second guide screw 242 having the same shape and size as those of the first guide screw 241 is fastened to the vertical frame plate 24 through the second guide opening 54. The connecting member 5 is attached to the vertical frame plate 24 only via the first guide screw 241 and the second guide screw 242. Therefore, the connecting member 5 can be displaced in the front-back direction within a range corresponding to the length of the first and second guide openings 53, 54 in the front-back direction, as well as in the up-down direction within a range corresponding to the height of the sloped portions 532, 542.

In FIG. 6, the first and second guide screws 241, 242 are abutted to the inner wall of the respective front end portions of the first and second guide openings 53, 54 (horizontal portions 531, 541) in the vertical frame plate 24. In this state, the connecting member 5 is displaced to the rearmost position. In FIG. 7, in contrast, the first and second guide screws 241, 242 are abutted to the inner wall of the respective rear end portions of the first and second guide openings 53, 54 (sloped portions 532, 542) in the vertical frame plate 24. In this state, the connecting member 5 is displaced to the forwardmost position. In this state, a front portion 51F of the vertical plate portion 51 sticks out forward from the front vertical frame 25F. In addition, the first and second guide screws 241, 242 respectively guide the sloped portions 532, 542, and hence the connecting member 5 descends from the position shown in FIG. 6 to a different height level. At this point, the lower face of the top plate 52 is located close to the upper edge 24T of the vertical frame plate 24.

The connecting member 5 also includes a bent portion 512 bent to the left from the front end of the front portion 51F. The bent portion 512 includes a screw hole 513 formed at a position close to the upper end portion thereof. The user can hold the bent portion 512 to displace the connecting member 5, either by pressing backward (setting inside the post-processing apparatus 2) or pulling forward (drawing out from the post-processing apparatus 2). The mentioned configuration allows the user to shift the position of the connecting member 5 from the side of the front face 20F of the post-processing apparatus 2 to which the user is constantly opposed, and thereby contributes to improving the work efficiency.

The window 55 is wider than the guide openings 53, 54 and extends in the front-back direction, and includes a horizontal portion 551 and a sloped portion 552 obliquely extending backward from the rear end of the horizontal portion 551 at an upward angle of approximately 30 degrees. The vertical frame plate 24 includes a long hole 243 (hole) having a vertically oriented major axis and formed at the position corresponding to the window 55. The aforementioned positioning pin 33 is to be inserted in the long hole 243. The displacement of the connecting member 5 is performed after the positioning pin 33 is inserted in the long hole 243. The window 55 serves to avoid interference between the positioning pin 33 inserted in the long hole 243 and the connecting member 5, while the connecting member 5 is being displaced.

In the state shown in FIG. 6, in which the connecting member 5 is at the rearmost position, the long hole 243 is exposed in the window 55 close to the front end thereof. Here, a rib 244 is formed on the vertical frame plate 24 so as to penetrate through the window 55. In the state shown in FIG. 6, the rib 244 is abutted to the inner wall of the front end portion of the window 55 in the vertical plate portion 51, and thus serves as a stopper. In contrast, in the state shown in FIG. 7 in which the connecting member 5 is at the forwardmost position, the long hole 243 is exposed in the sloped portion 552 of the window 55. Thus, the sloped portion 552 keeps the window 55 uncovered with the vertical plate portion 51 even when the connecting member 5 is downwardly displaced. With the mentioned configuration, the post-processing apparatus 2 can be brought adjacent to the image forming apparatus 1 and positioned therewith in the front-back direction by inserting the positioning pin 33 in the long hole 243, and the connecting member 5 can be displaced after the positioning is performed until the level difference between the apparatuses 1 and 2 in the up-down direction enters a predetermined tolerance.

A retention member 56 that holds the second connector 6 is provided in a rear portion 51B of the vertical plate portion 51, so as to move in the up-down direction with respect to the connecting member 5. The retention member 56 includes a flat main plate 561 of a generally trapezoidal shape, and a pair of long holes 562 aligned on the main plate 561 with a spacing therebetween in the up-down direction. The long holes 562 each have the major axis oriented vertically.

A pair of guide screws 563 are fastened to the vertical plate portion 51 through the respective long holes 562. The head of the guide screw 563 is larger than the opening width of the long hole 562 in the left-right direction, and the stem of the guide screw 563 has a diameter smaller than the opening width. The distance between the head of the guide screw 563 and the vertical plate portion 51 is larger than the plate thickness of the main plate 561. Therefore, the retention member 56 can be displaced in the up-down direction within a range corresponding to the length of the major axis of the long hole 562.

A circular column-shaped guide pin 564 (part of the retention member to be guided) is formed on the right surface of the main plate 561 so as to project to the right (first direction). The guide pin 564 is located between the pair of long holes 562 and closer to the upper one. As will be subsequently described in details, the guide pin 564 is inserted in the guide space 34G in the guide unit 34 of the fixed member 3 and abuts against the sloped surfaces 351, 361, so that the height level of the retention member 56 can be adjusted. Here, the retention member 56 includes a guide edge 565 bent along the front end of the main plate 561 with a narrow stepped portion. In addition, a raised portion 511 is formed on the rear portion 51B of the vertical plate portion 51, so as to enclose the guide edge 565. When the retention member 56 moves up or downward, the raised portion 511 serves to guide the guide edge 565.

Figure 8:
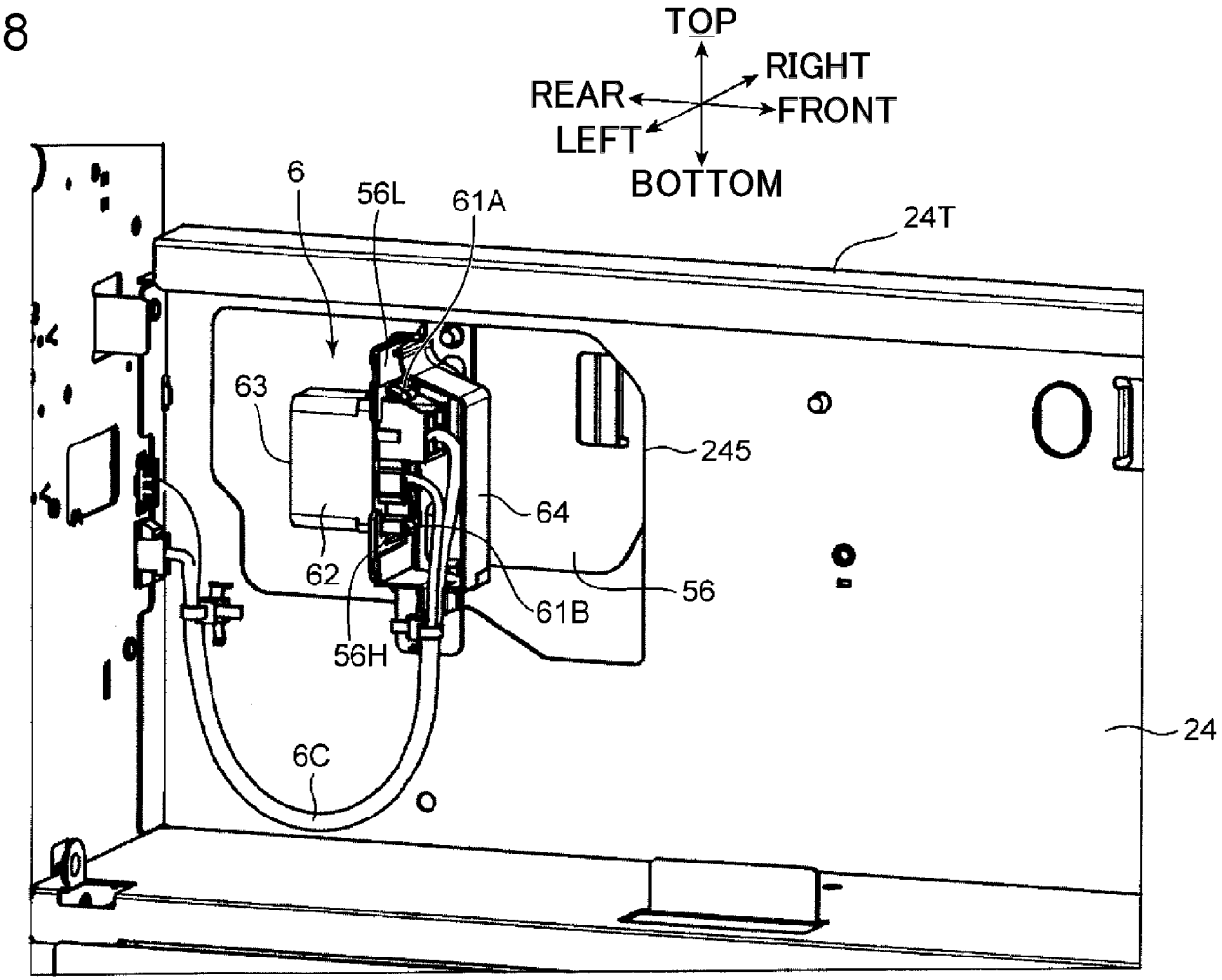
FIG. 8 is an enlarged fragmentary perspective view showing a second connector.

FIG. 8 is a perspective view showing the second connector 6. The second connector 6 is a drawer connector that can be fitted with the first connector 4, and mounted on the connecting member 5 (retention member 56). Accordingly, the second connector 6 is displaced in the front-back direction and the up-down direction by the displacement of the connecting member 5, and also displaced in the up-down direction when the retention member 56 is displaced up or downward. The second connector 6 is attached to the left face of the retention member 56.

The second connector 6 includes a connector housing 62 that accommodates a plurality of connector pins, a connector opening 63 located in the rear end face of the connector housing 62, in which the first connector 4 is to be fitted, and nail portions 61A, 61B that hold the connector. The second connector 6 is inserted in an opening 56H formed in a left bent portion 56L of the retention member 56, and fastened with the nail portions 61A, 61B. The opening 56H is larger than the connector housing 62. The second connector 6 is slightly movable in the up-down direction and the left-right direction within a range corresponding to the area of the opening 56H. Accordingly, even when the connector opening 63 and the connector opening 43 of the first connector 4 are slightly deviated from each other, such deviation can be absorbed by the mobility of the second connector 6, and therefore the connectors can be fitted with each other. Here, a cable is protected by a connecter holder 64.

An end portion of a second cable 6C is connected to the second connector 6. The second cable 6C is a communication cable, and the other end portion thereof is electrically connected to the post processing unit 200 installed in the main housing 20 of the post-processing apparatus 2. The former end portion of the second cable 6C is introduced in a connector holder 64. The second cable 6C and the connector holder 64 are also displaced when the connecting member 5 is displaced. Therefore, the vertical frame plate 24 includes a window 245 having a size corresponding to that of the connector holder 64, to allow the displacement of the second cable 6C and the connector holder 64.

Figure 9:
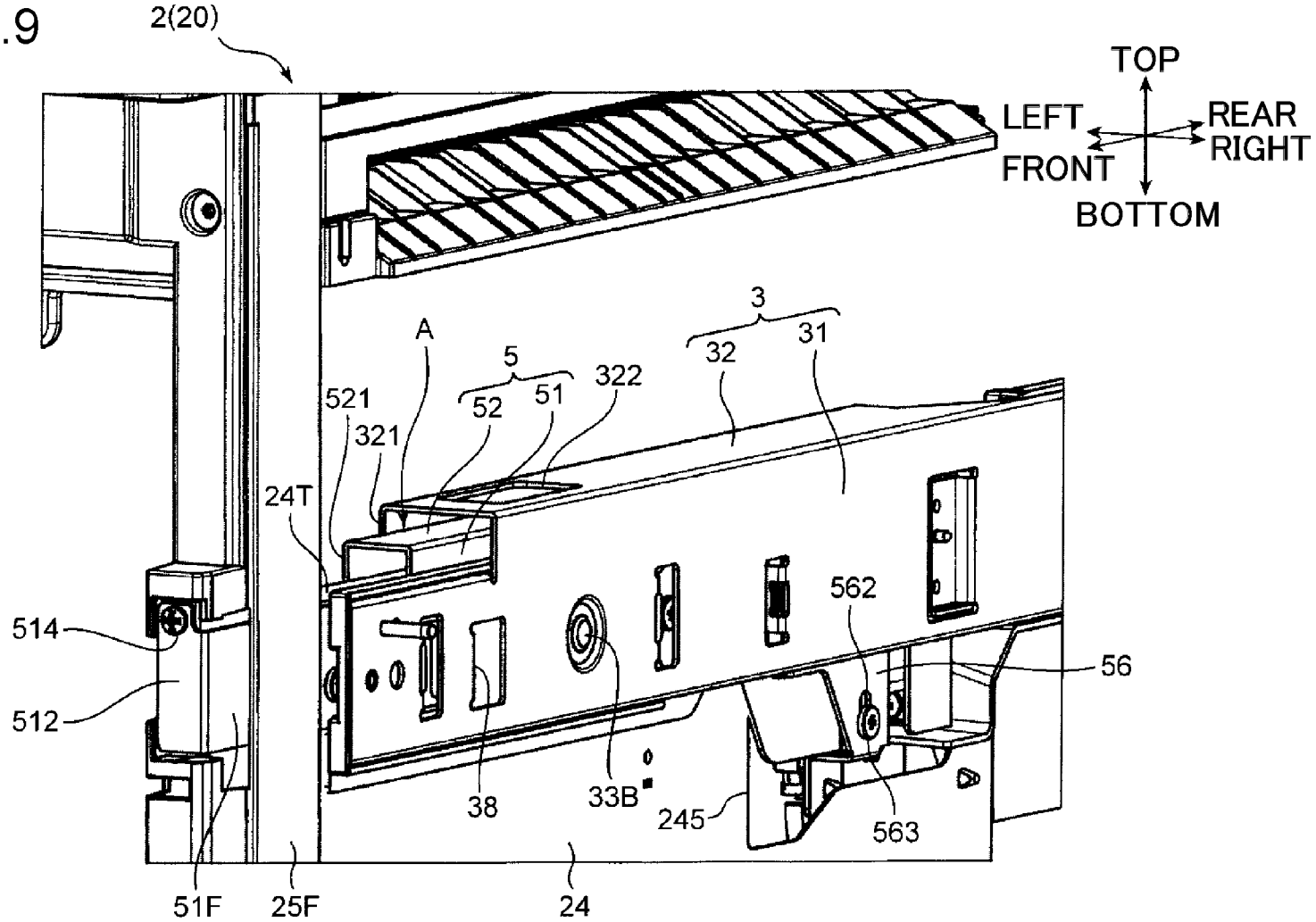
FIG. 9 is a fragmentary perspective view for explaining the engagement between the fixed member and the connecting member in a left-right direction, in which the connecting member is set to the engaging position.
Figure 10:
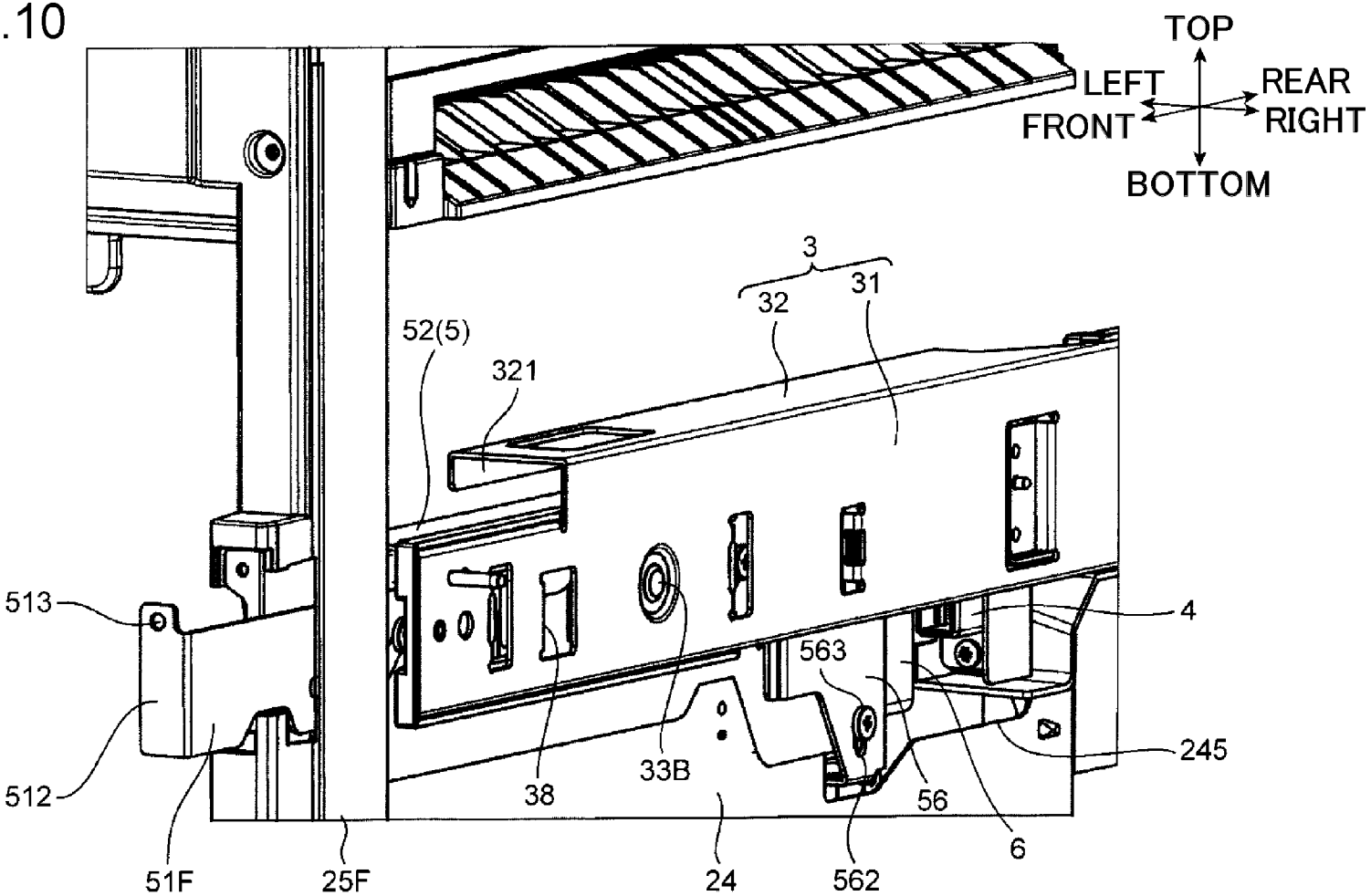
FIG. 10 is a fragmentary perspective view for explaining the engagement between the fixed member and the connecting member in a left-right direction, in which the connecting member is set to the disengaging position.

Referring now to FIGS. 9 and 10, the mechanical connection and disconnection between the image forming apparatus 1 (fixed member 3) and the post-processing apparatus 2 (connecting member 5) will be described. FIGS. 9 and 10 are perspective views for explaining the engagement between the fixed member 3 and the connecting member 5 in the front-back direction, FIG. 9 illustrating the connecting member 5 in the engaging position and FIG. 10 illustrating the connecting member 5 in the disengaging position. In these drawings, only the fixed member 3 is illustrated on the side of the image forming apparatus 1, and the main housing 10 is excluded. On the right face of the vertical plate portion 31 of the fixed member 3, a base portion 33B of the positioning pin 33 is exposed.

The position of the connecting member 5 shown in FIG. 9 corresponds to the state shown in FIG. 6 (engaging position). In this state, the post-processing apparatus 2 is connected to the image forming apparatus 1. More specifically, a screw 514 is fitted in the screw hole 513 (see FIG. 7) in the bent portion 512 at the front end of the connecting member 5, and thus the connecting member 5 is fixed to the front vertical frame 25F. In other words, the connecting member 5 is disabled from moving in the front-back direction. As will be subsequently described in details, the first connector 4 and the second connector 6 are fitted with each other in this state.

The connecting member 5 and the fixed member 3 are disposed such that the vertical plate portion 31 and the vertical plate portion 51 closely oppose each other in parallel, the top plate 52 and the horizontal plate portion 32 oppose each other, and the hanging plate 521 (part of the connecting member) and the lock portion 321 (portion for engagement) oppose each other. In other words, the connecting member 5 is accommodated in a space defined by the vertical plate portion 31, the horizontal plate portion 32, and the lock portion 321 of the fixed member 3.

When the connecting member 5 is set to the engaging position, the top plate 52 of the connecting member 5 is located close to the horizontal plate portion 32 of the fixed member 3. This is because the first and second guide screws 241, 242 are respectively engaged with the horizontal portions 531, 541 of the first and second guide openings 53, 54, and hence the connecting member 5 is elevated to the higher position. In this state, the hanging plate 521 and the lock portion 321 partially overlap in the left-right direction, so as to interfere with each other. The portion indicated by an arrow A in FIG. 9 is the interference portion. The interference portion A formed by the hanging plate 521 and the lock portion 321 restricts the post-processing apparatus 2 from being separated from the image forming apparatus 1 to the left. Thus, the apparatuses 1 and 2 are mechanically connected to each other. In the engaging position, the left edge of a rectangular plate 38 (see FIGS. 3 and 4) raised to the left from the vertical plate portion 31 of the fixed member 3 and the right face of the lock portion 321 enclose therebetween the right face of the vertical plate portion 51 of the connecting member 5 and the left face of the hanging plate 521. Therefore, the connecting member 5 is substantially restricted from moving in the left-right direction.

In contrast, the position of the connecting member 5 shown in FIG. 10 corresponds to the state shown in FIG. 7 (disengaging position). In this state the post-processing apparatus 2 can be separated from the image forming apparatus 1. More specifically, the screw 514 (see FIG. 9) is removed from the screw hole 513 in the bent portion 512 of the connecting member 5, and the front portion 51F of the connecting member 5 sticks out forward from the front vertical frame 25F. In this state, the first connector 4 and the second connector 6 are disengaged from each other.

When the connecting member 5 is set to the disengaging position, the top plate 52 of the connecting member 5 is spaced from the horizontal plate portion 32 of the fixed member 3. This is because the first and second guide screws 241, 242 are respectively engaged with the rear end portion of the sloped portions 532, 542 of the first and second guide openings 53, 54, and hence the connecting member 5 is relatively displaced to the lower height level. The hanging plate 521 located at the height level of the disengaging position no longer overlaps the lock portion 321 in the left-right direction, and hence the interference portion A is cancelled. Thus, the inclination height of the sloped portions 532, 542 is determined according to the size of the interference portion A between the hanging plate 521 and the lock portion 321, formed and cancelled by the displacement of the connecting member 5 between the engaging position and the disengaging position.

In this state, the mechanical connection between the image forming apparatus 1 and the post-processing apparatus 2 is cancelled, and hence the post-processing apparatus 2 can be separated from the image forming apparatus 1 to the left. The configuration according to this embodiment enables, with the difference in height level originating from the displacement of the connecting member 5, creation of the state where the image forming apparatus 1 and the post-processing apparatus 2 are mechanically connected because of the interference between the lock portion 321 and the hanging plate 521, and the state where the image forming apparatus 1 and the post-processing apparatus 2 are released from the mechanical connection because of the cancellation of the interference between the lock portion 321 and the hanging plate 521. Thus, the apparatuses 1 and 2 can be mechanically connected and disconnected with a simplified mechanism. Here, the post-processing apparatus 2 can also be moved in the front-back direction, by moving the post-processing apparatus 2 to the left until the positioning pin 33 is disengaged from the long hole 243.

In this embodiment, the first connector 4 and the second connector 6, which are disengaged from each other when the connecting member 5 is set to the disengaging position (FIGS. 7 and 10), are fitted with each other when the connecting member 5 is displaced to the engaging position (FIGS. 6 and 9). Hereunder, the engagement between the first connector 4 and the second connector 6 will be described. FIGS. 11 to 16 are partially cut away side views for explaining the process from height level adjustment to engagement, between the first connector 4 and the second connector 6.

Figure 11:
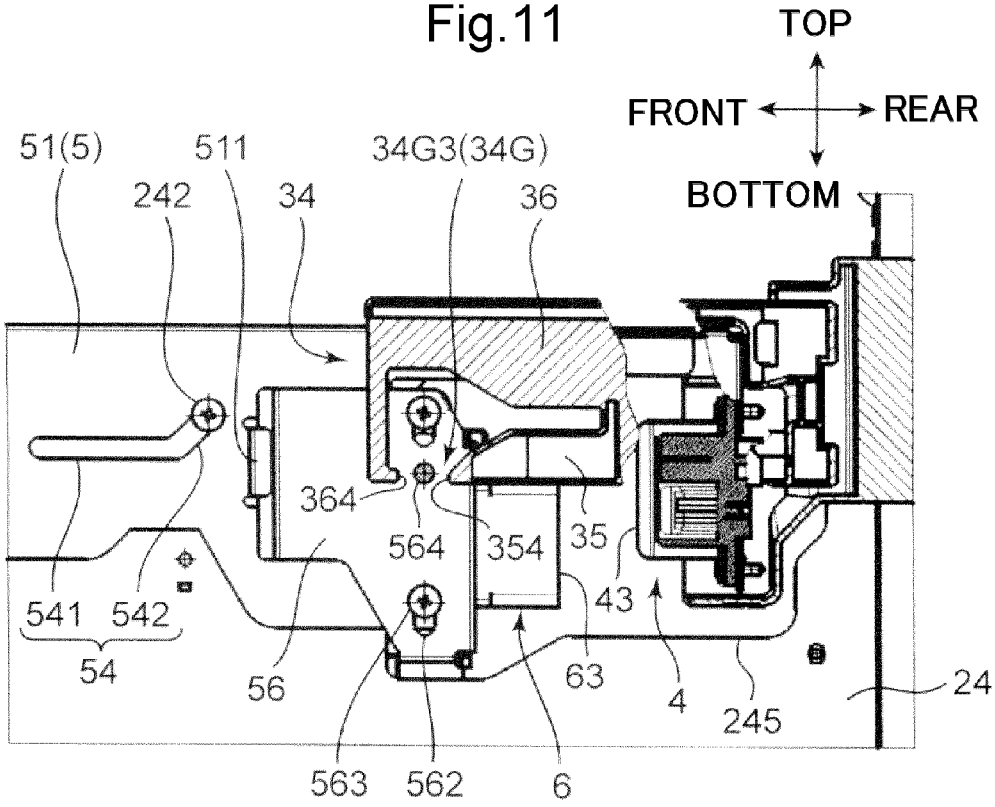
FIG. 11 is a partially cut away side view for explaining a process from height level matching between the first connector and the second connector to engagement therebetween.

FIG. 11 illustrates the connecting member 5 in the disengaging position (FIGS. 7 and 10). Before reaching the state shown in FIG. 11, the positioning pin 33 of the image forming apparatus 1 is inserted in the long hole 243 of the post-processing apparatus 2. Accordingly, the image forming apparatus 1 and the post-processing apparatus 2 are brought close to each other such that the left side face 10L of the image forming apparatus 1 and the right side face 20R of the post-processing apparatus 2 closely oppose each other, and the positioning between the apparatuses 1 and 2 in the front-back direction is completed. In addition, the length of the long hole 243 in the up-down direction is determined so as to allow the positioning pin 33 to be inserted therein provided that the difference in height level between the apparatuses 1 and 2 are generally within a tolerance. Here, the tolerance of the difference in height level corresponds to a permissible deviation in the up-down direction that allows the sheet to be delivered, between the sheet outlet 14 of the image forming apparatus 1 and the sheet inlet 23 of the post-processing apparatus 2. In case that the difference in height level between the apparatuses 1 and 2 exceeds the tolerance and the positioning pin 33 is unable to be inserted in the long hole 243, the height of the post-processing apparatus 2 can be adjusted with a non-illustrated level adjuster provided to the casters 22.

In the state shown in FIG. 11, the guide pin 564 projecting from the retention member 56 retaining the second connector 6 is located in the introduction space 34G3 (between the front end 354 and the lower end 364) in the guide space 34G of the guide unit 34 of the fixed member 3. This is the position of the guide pin 564 in the state where the post-processing apparatus 2 is moved from the left to the right with the connecting member 5 set to the disengaging position (drawn out forward) and the positioning pin 33 is inserted in the long hole 243.

At this point, the second guide screw 242 is abutted to the inner wall of the rear end portion of the second guide opening 54, more precisely the sloped portion 542. Although not included in FIG. 11, the first guide screw 241 is in the same position. The retention member 56 is lowered because of the self-weight, and hence the guide screws 563 are each abutted to the upper edge of the corresponding long hole 562. Although the connector opening 43 of the first connector 4 and the connector opening 63 of the second connector 6 oppose each other, the openings are spaced from each other in the front-back direction and also at different height levels. Such difference in height level between the image forming apparatus 1 and the post-processing apparatus 2 originates from, for example, the positional shift of the image forming apparatus 1 from a predetermined position due to sinking into the carpet on the floor. However, the amount of such positional shift is within a range that allows the positioning pin 33 to move inside the long hole 243 in the up-down direction.

Figure 12:
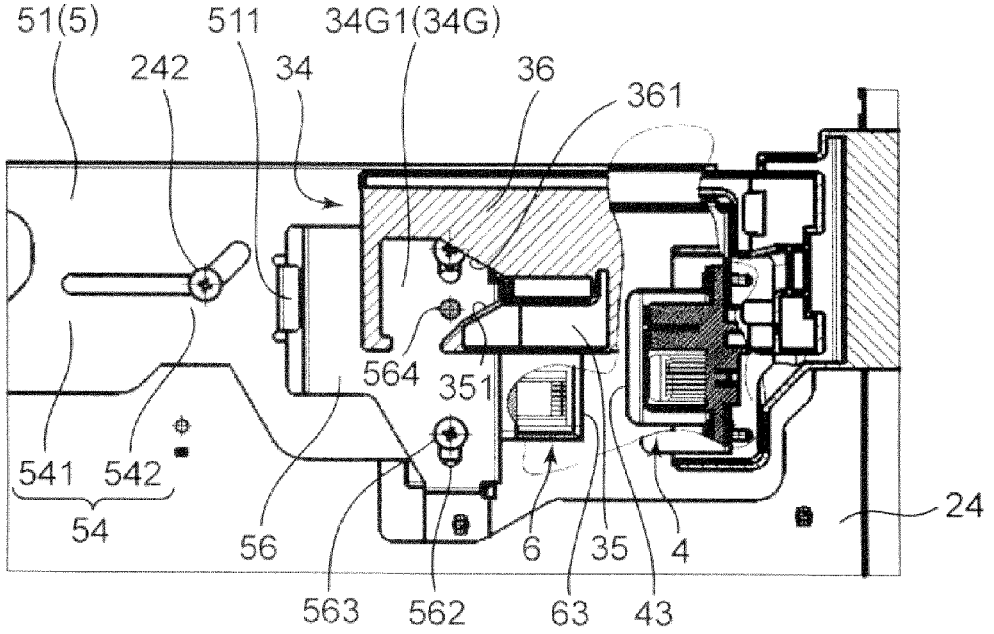
FIG. 12 is another partially cut away side view for explaining the process from the height level matching between the first connector and the second connector to the engagement therebetween.

Thereafter, the guide unit 34 guides the guide pin 564 while the connecting member 5 is displaced from the disengaging position to the engaging position, thereby performing preliminary adjustment of the height level of the second connector 6 with respect to the first connector 4, into a predetermined tolerance. FIG. 12 illustrates the state where the connecting member 5 has been pressed backward from the position shown in FIG. 11, by a distance corresponding to the length of the sloped portion 542 in the front-back direction. The second guide screw 242 is located at the boundary between the sloped portion 542 and the horizontal portion 541 in the second guide opening 54.

In this state, the connecting member 5 is elevated because of the engagement between the second guide opening 54 and the second guide screw 242. Accordingly, the hanging plate 521 and the lock portion 321 can interfere with each other in the left-right direction. The guide pin 564 has entered the tapered guide space 34G1 in the guide space 34G. In the case where the image forming apparatus 1 and the post-processing apparatus 2 are largely different in height level, the guide pin 564 abuts against either the sloped surface 351 of the lower guide member 35 or the sloped surface 361 of the upper guide member 36 at this point. In the example shown in FIG. 12, the guide pin 564 is in contact with neither of the sloped surfaces 351, 361 yet, and hence the retention member 56 has not moved at all in the up-down direction. Therefore, the preliminary adjustment of the height level between the first connector 4 and the second connector 6 has not yet been performed.

Figure 13:
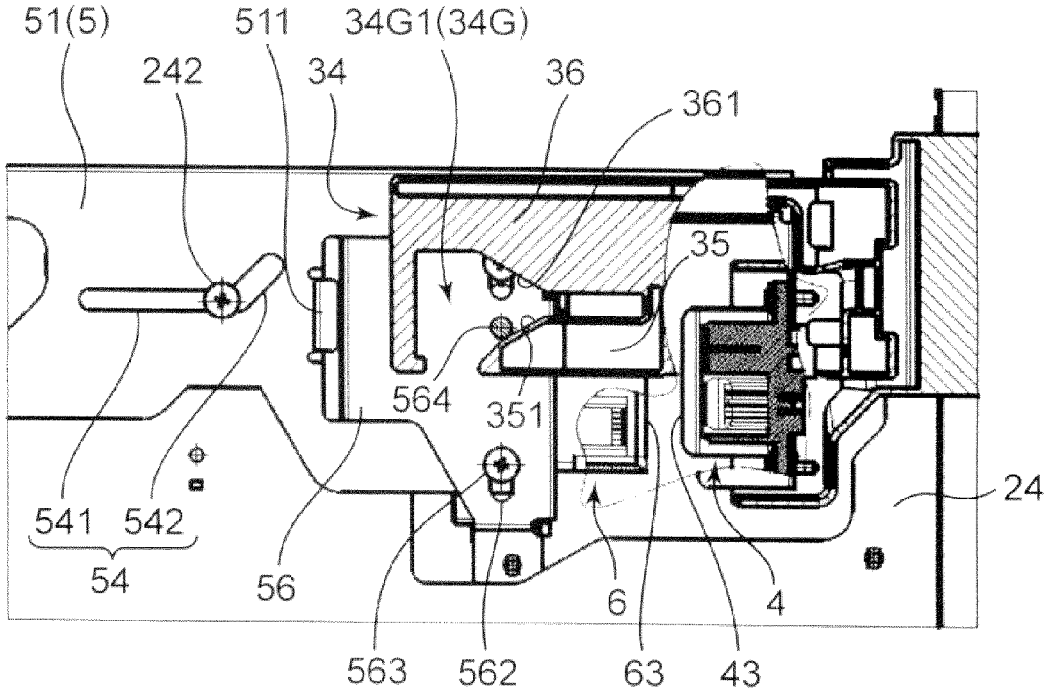
FIG. 13 is still another partially cut away side view for explaining the process from the height level matching between the first connector and the second connector to the engagement therebetween.

FIG. 13 illustrates the state where the connecting member 5 has been pressed slightly further backward, from the state shown in FIG. 12. At this point, the guide pin 564 has entered into contact with the sloped surface 351. Thereafter, as the connecting member 5 is pressed further backward, the guide pin 564 is guided so as to climb up along the sloped surface 351. In other words, the preliminary adjustment is performed. Because of the guide pin 564 being guided, the retention member 56 is gradually elevated with respect to the vertical plate portion 51. Accordingly, the height levels of the respective connector openings 43, 63 of the first and second connectors 4, 6 gradually become aligned.

Figure 14:
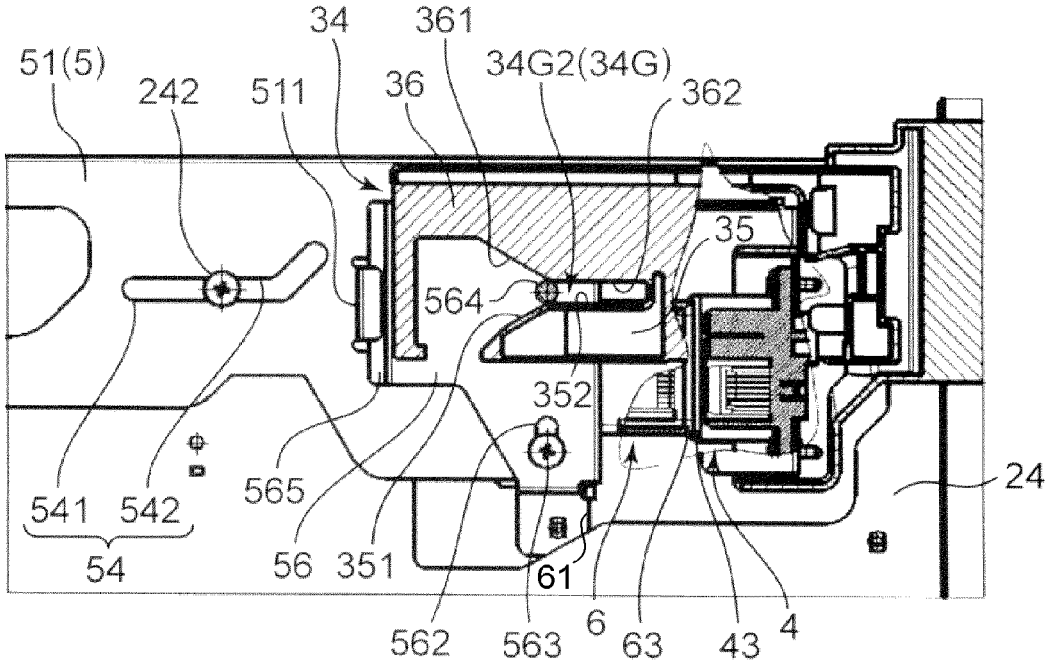
FIG. 14 is still another partially cut away side view for explaining the process from the height level matching between the first connector and the second connector to the engagement therebetween.

FIG. 14 illustrates the state where the connecting member 5 has been pressed further backward from the state shown in FIG. 13. The second guide screw 242 is located close to the center of the horizontal portion 541 of the second guide opening 54, in the front-back direction. In FIG. 14, the guide pin 564 has climbed all the way along the sloped surface 351 and reached the vicinity of the entrance of the slit-shaped space 34G2 defined by the lower horizontal surface 352 and the upper horizontal surface 362. The retention member 56 has been elevated to a height level close to the upper limit with respect to the vertical plate portion 51, and the guide screws 563 are close to the lower end of the respective long holes 562. At this point, the preliminary adjustment has been completed. The stroke range of the retention member 56 in the up-down direction, i.e., the stroke range of the guide screw 563 within the long hole 562 is determined so as to generally agree with the stroke range of the positioning pin 33 within the long hole 243 in the up-down direction.

In the state shown in FIG. 14, the height levels of the respective connector openings 43, 63 of the first and second connectors 4, 6 are aligned with each other. More specifically, the connector opening 43 and the connector opening 63 are restricted from being deviated from each other, in excess of an extent that can be absorbed by the movable range of the base member 61 of the second connector 6 with respect to the, connector holder 64 (see FIG. 8), in the up-down direction as well as left-right direction.

Figure 15:
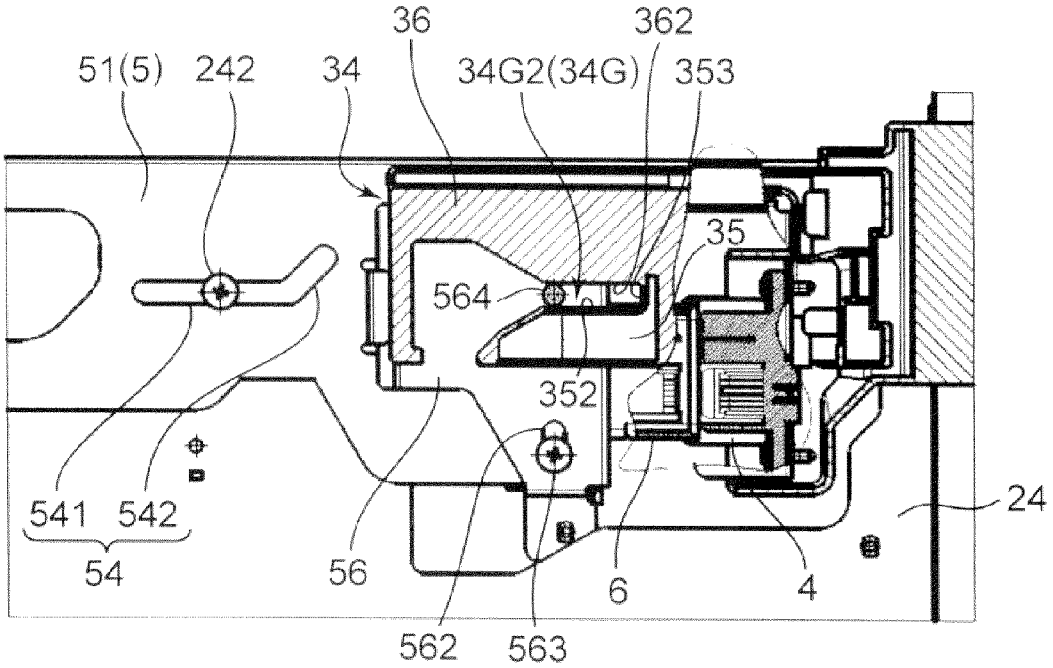
FIG. 15 is still another partially cut away side view for explaining the process from the height level matching between the first connector and the second connector to the engagement therebetween.

FIG. 15 illustrates the state where the connecting member 5 has been pressed slightly further backward, from the state shown in FIG. 14. In FIG. 15, the guide pin 564 has entered the front end portion of the slit-shaped space 34G2. At this point, the first connector 4 and the second connector 6 have already started to be fitted with each other. The connector opening 63 of the second connector 6 includes a tapered surface formed along the periphery thereof, so that the second connector 6 may slightly move when receiving the first connector 4 in the initial stage of the engagement, and that the connectors 4 and 6 are finally positioned with respect to each other.

Figure 16:
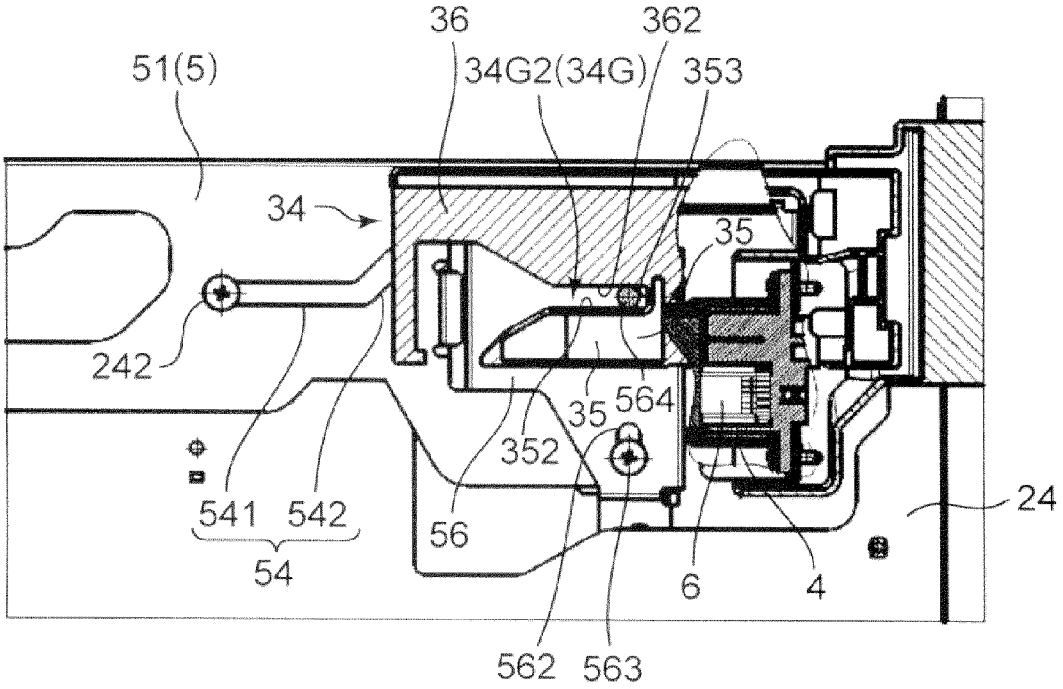
FIG. 16 is still another partially cut away side view for explaining the process from the height level matching between the first connector and the second connector to the engagement therebetween.

FIG. 16 illustrates the state where the connecting member 5 has been pressed backward from the position shown in FIG. 15, by a distance corresponding to the length of the slit-shaped space 34G2 in the front-back direction. The second guide screw 242 is located at the front end portion of the horizontal portion 541 of the second guide opening 54. The guide pin 564 has reached the vicinity of the rear end portion of the slit-shaped space 34G2 and is located close to the abutment surface 353. At this point, the first connector 4 and the second connector 6 are completely fitted with each other. In other words, the first cable 4C and the second cable 6C are electrically connected to each other, and the post processing unit 200 of the post-processing apparatus 2 is ready to operate under the control of the control unit 100C of the image forming apparatus 1.

As described above, with the configuration according to this embodiment, not only the mechanical connection between the image forming apparatus 1 and post-processing apparatus 2, but also the engagement between the first connector 4 and the second connector 6 are achieved at the same time, upon displacing the connecting member 5 from the disengaging position to the engaging position. In other words, the user can connect the image forming apparatus 1 and the post-processing apparatus 2 both mechanically and electrically simply by moving the connecting member 5 in the front-back direction, and therefore the work efficiency is significantly improved.

In particular, the second connector 6 can be displaced in the up-down direction because of being retained by the retention member 56, and the height level of the second connector 6 can be adjusted by the guiding function of the guide unit 34 with respect to the guide pin 564. Therefore, even when the image forming apparatus 1 and the post-processing apparatus 2 are at different height levels, the user can properly connect the first connector 4 and the second connector 6 to each other simply by moving the connecting member 5 in the front-back direction without the need to perform any additional process.

To be more detailed, the image forming apparatus 1 and the post-processing apparatus 2 can be positioned with each other within the stroke range of the positioning pin 33 within the long hole 243, upon inserting the positioning pin 33 in the long hole 243 thereby bringing the apparatuses 1 and 2 closely adjacent to each other. In addition, since the movable range of the retention member 56 in the up-down direction is determined according to the stroke range of the positioning pin 33 within the long hole 243, the difference in height level can be corrected by moving the retention member 56 up or downward even when the apparatuses 1 and 2 are at different height levels. Therefore, the height level the first connector 4 and the second connector 6 can be properly fitted with each other, despite the apparatuses 1 and 2 being at different height levels.

Further, the fixed member 3 and the connecting member 5 are unable to be mechanically connected to each other unless the image forming apparatus 1 and the post-processing apparatus 2 are brought adjacent to each other in the left-right direction within a predetermined spacing. As described above referring to FIGS. 11 to 16, when the connecting member 5 is moved toward the engaging position from the disengaging position the preliminary adjustment between the first connector 4 and the second connector 6 is performed, and then the first connector 4 and the second connector 6 are completely fitted with each other by further backward movement of the connecting member 5.

With the foregoing configuration, when the connecting member 5 is displaced with the left side face 10L of the image forming apparatus 1 and the right side face 20R of the post-processing apparatus 2 excessively spaced from each other, the top plate 52 of the connecting member 5 collides with the lower edge of the lock portion 321 of the fixed member 3. Accordingly, the connecting member 5 is disabled from being elevated and from proceeding backward. Therefore, the user can recognize that the image forming apparatus 1 and the post-processing apparatus 2 are not properly located for the connection, because of the connecting member 5 being unable to be operated. In addition, the first connector 4 and the second connector 6 can be prevented from being forcibly and improperly fitted with each other despite the apparatuses 1 and 2 not being properly located for the connection.

Consequently, this embodiment provides the image forming apparatus that constitutes a part of combined units configured so as to easily and securely connect two units both mechanically and electrically.

Second Embodiment

Referring now to FIGS. 17 to 26, a fixed member 3A and a connecting member 5A according to a second embodiment of the disclosure will be described hereunder. In the first embodiment, the connecting member 5 is displaced in the up-down direction (third direction) while being displaced in the front-back direction (second direction). In the second embodiment, the connecting member 5A is restricted from moving in the up-down direction, i.e., only allowed to move in the front-back direction, and the fixed member 3A is configured according to such structure of the connecting member 5A.

Figure 17:
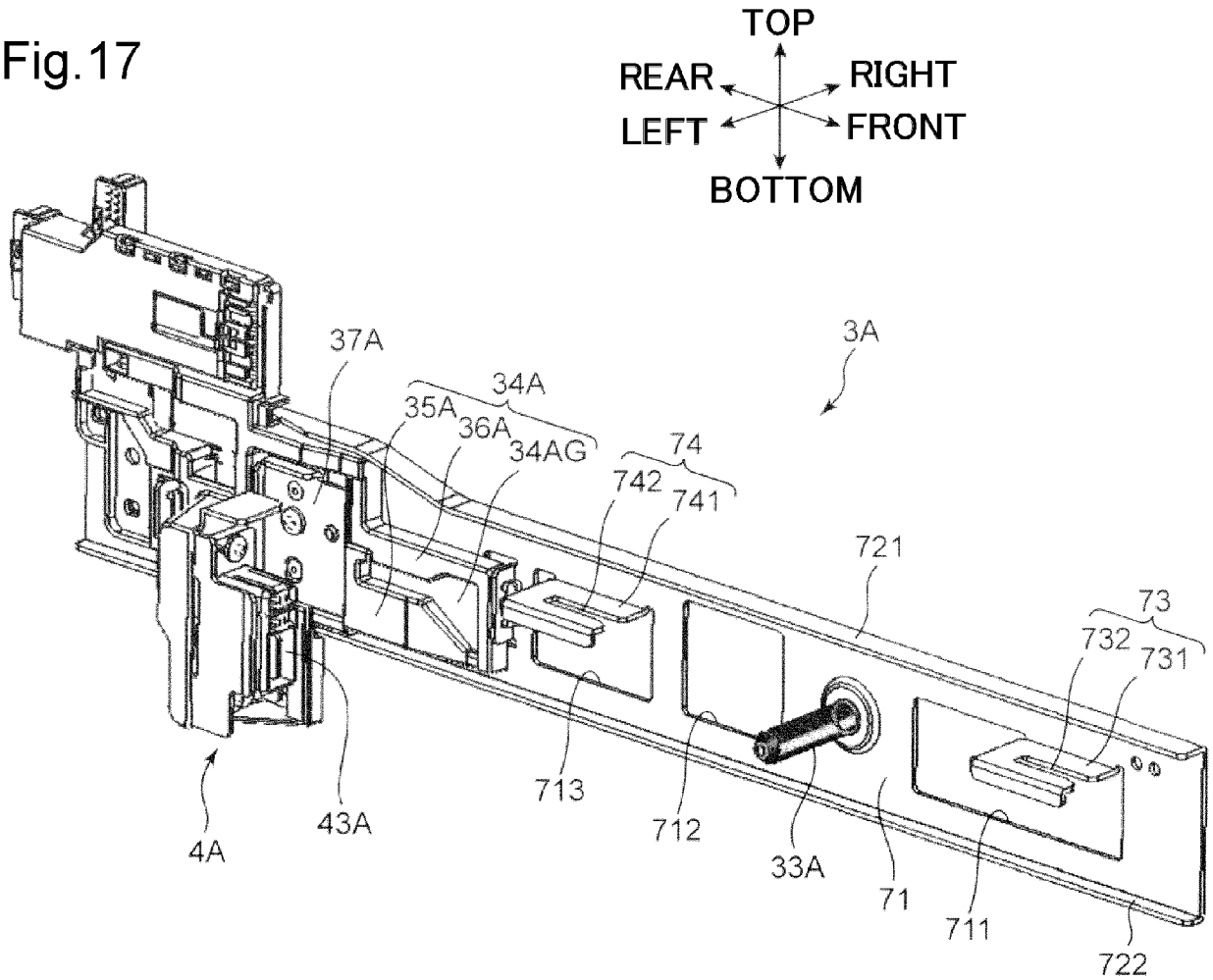
FIG. 17 is a perspective view showing a fixed member according to a second embodiment.
Figure 18:
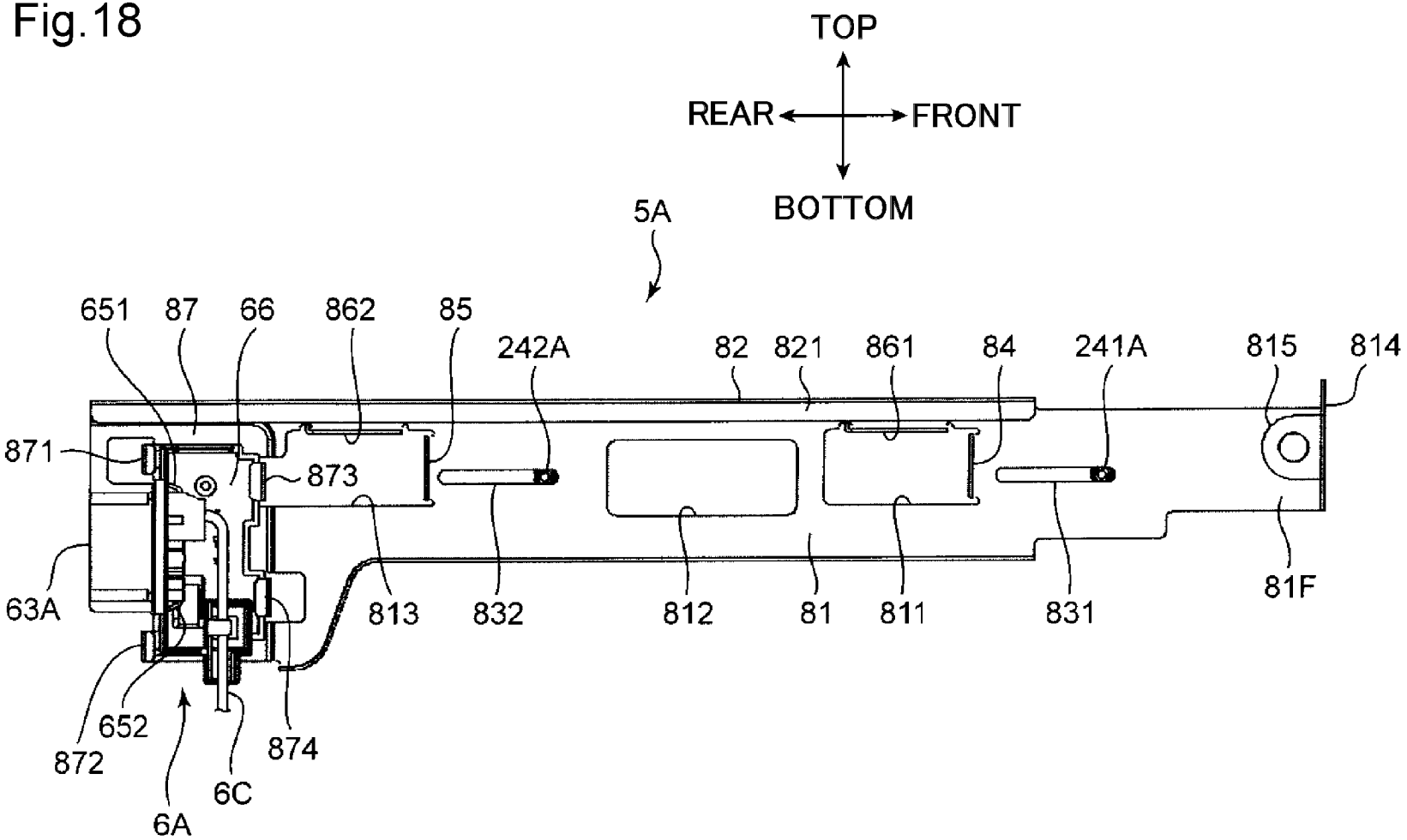
FIG. 18 is a left side view showing a connecting member according to the second embodiment.
Figure 19:
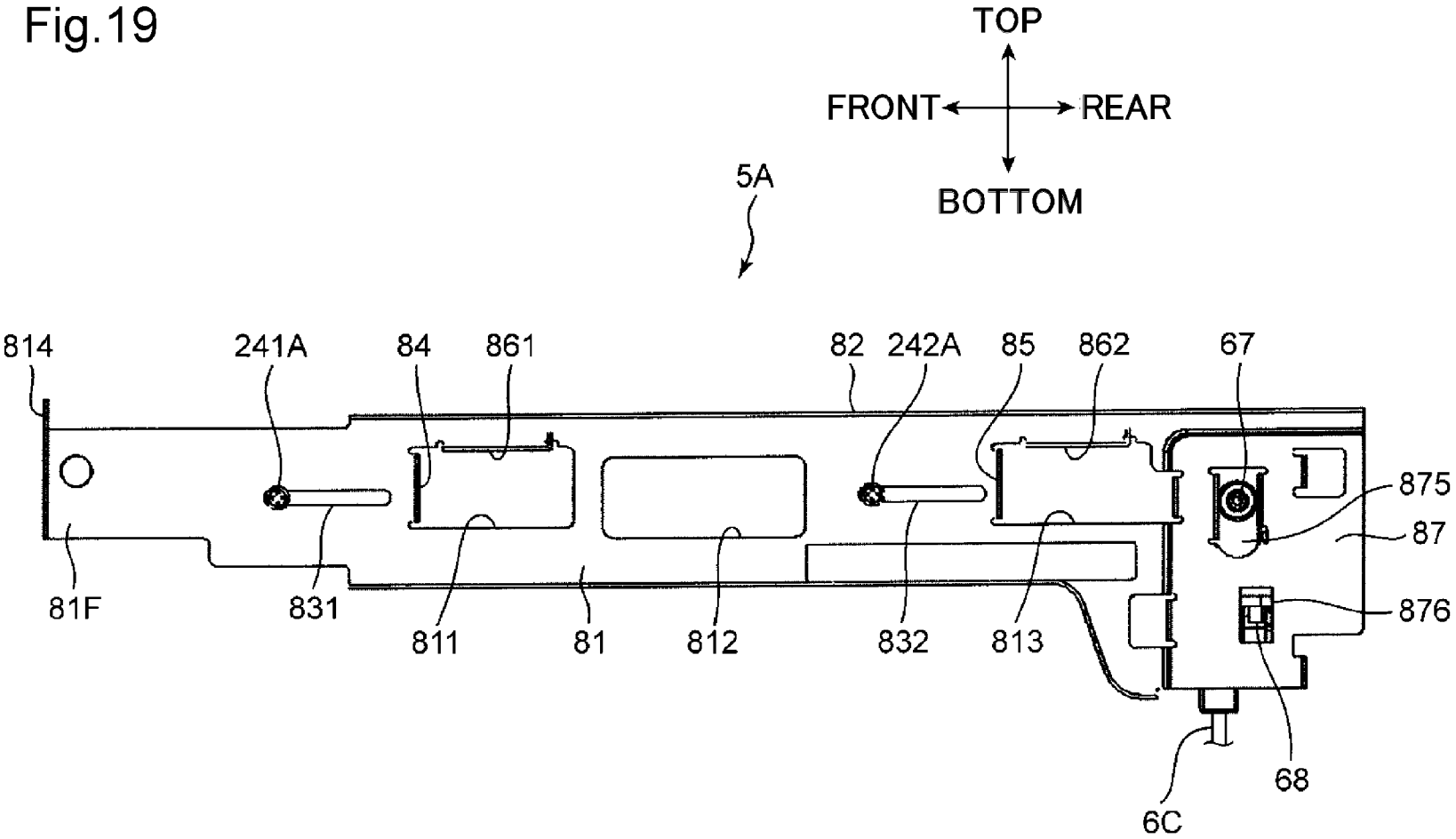
FIG. 19 is a right side view showing the connecting member according to the second embodiment.
Figure 20:
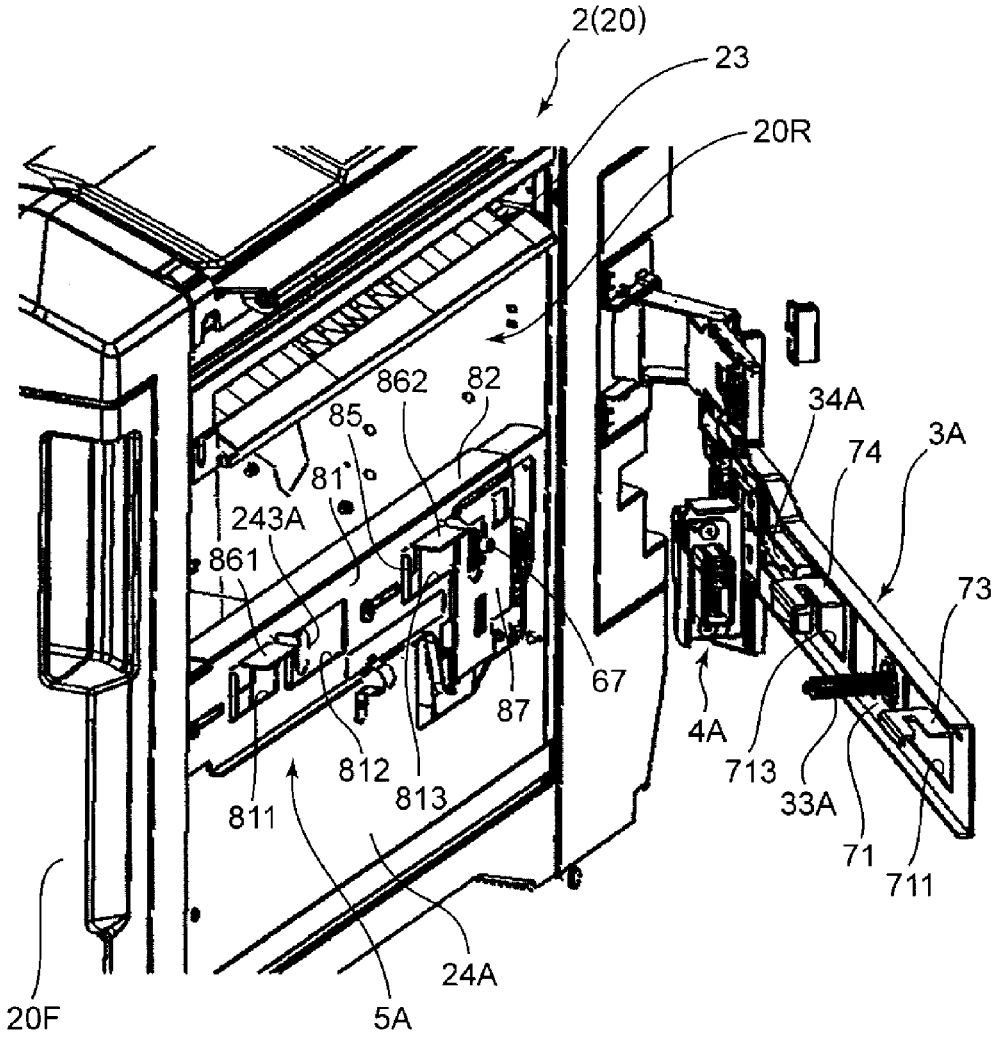
FIG. 20 is a fragmentary perspective view showing a post-processing apparatus with the connecting member according to the second embodiment attached thereto, and the fixed member according to the second embodiment.
Figure 21:
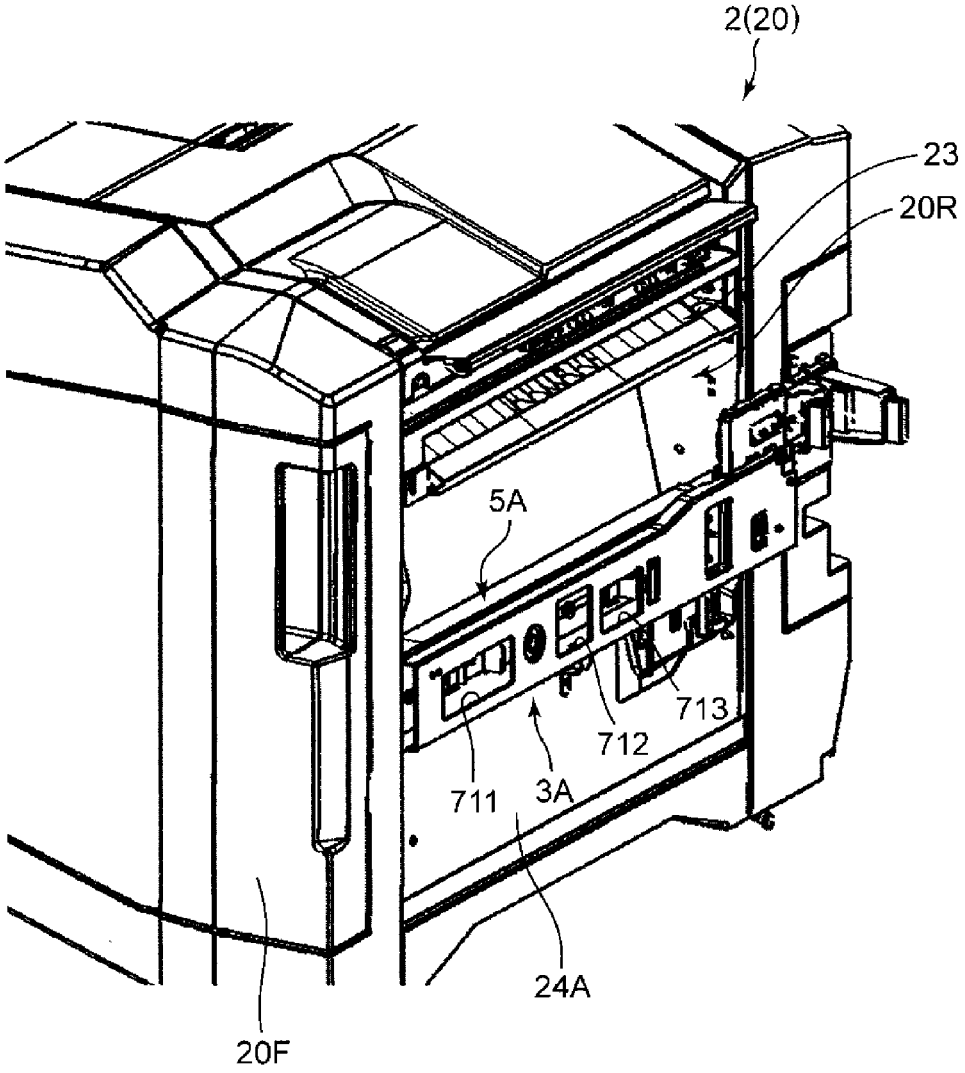
FIG. 21 is a fragmentary perspective view showing the fixed member in FIG. 20 attached to the connecting member.

FIG. 17 is a perspective view showing the fixed member 3A. FIG. 18 is a left side view of the connecting member 5A, and FIG. 19 is a right side view thereof. FIGS. 20 and 21 are perspective views each showing the post-processing apparatus 2 with the connecting member 5A attached thereto and the fixed member 3A. In FIG. 20 the right face of the connecting member 5A is exposed, and in FIG. 21 the fixed member 3A is attached to the connecting member 5A.

The fixed member 3A retains a first connector 4A, and is fixed to the left side face 10L (see FIGS. 2, 3) of the image forming apparatus 1 with a screw. The fixed member 3A is formed by bending a metal plate, and includes a flat vertical plate portion 71 extending in the front-back direction, and flat horizontal plate portions 721, 722 bent to the left from the upper and lower edges of the vertical plate portion 71, respectively, and extending in the front-back direction. The vertical plate portion 71 includes three rectangular openings aligned in the front-back direction, which are a first opening 711, a second opening 712, and a third opening 713.

A first lock portion 73 is formed on the upper edge of the first opening 711, the forwardmost one, so as to project to the left. The first lock portion 73 includes a first plate-shaped lug 731 and a first slit 732 formed in the first plate-shaped lug 731. The first plate-shaped lug 731 is a flat plate extending in the left-right direction (first direction), and formed by bending a lug portion to the left from the upper edge of the first opening 711. The first slit 732 extends in the front-back direction (second direction) through the central portion of the first plate-shaped lug 731 in the left-right direction. The first slit 732 has an opening at the front edge of the first plate-shaped lug 731 and linearly extends backward as far as the vicinity of the rear end portion of the first plate-shaped lug 731.

A second lock portion 74 is formed on the upper edge of the third opening 713, the rearmost one, so as to project to the left. The second lock portion 74 is located on the rear side of the first lock portion 73 with a spacing therefrom, at the same height level as the first lock portion 73, and includes a second plate-shaped lug 741 and a second slit 742. The second plate-shaped lug 741 is a flat plate extending in the left-right direction, and formed by bending a lug portion to the left from the upper edge of the third opening 713. The second slit 742 extends in the front-back direction through the central portion of the second plate-shaped lug 741 in the left-right direction. The second slit 742 has an opening at the front edge of the second plate-shaped lug 741 and linearly extends backward as far as the vicinity of the rear end portion of the second plate-shaped lug 741. The first slit 732 and the second slit 742 are aligned along the same axial line extending in the front-back direction.

The fixed member 3A further includes a positioning pin 33A, a guide unit 34A, and a mounting plate 37A. The positioning pin 33A serves for the positioning between the image forming apparatus 1 and the post-processing apparatus 2 in the front-back direction. The guide unit 34A serves to guide the second connector 6A to the position where the second connector 6A is fitted with the first connector 4A. The guide unit 34A includes a lower guide member 35A, an upper guide member 36A, and a guide space 34AG defined between the guide members 35A, 36A. The mounting plate 37A is a flat plate on which the first connector 4A is mounted. The first connector 4A is a drawer connector electrically connected with a circuit board in the image forming apparatus 1. The positioning pin 33A, the guide unit 34A, the mounting plate 37A, and the first connector 4A are configured in the same as the corresponding ones in the first embodiment, and therefore the detailed description will not be repeated.

The connecting member 5A retains a second connector 6A, and is attached to the right side face 20R, of the post-processing apparatus 2 so as to move only in the front-back direction. The connecting member 5A serves to mechanically connect the image forming apparatus 1 and the post-processing apparatus 2 so as not to be separated from each other in the left-right direction, by being engaged with the fixed member 3A. In other words, the connecting member 5A can be displaced in the front-back direction between the engaging position in which the connecting member 5A is engaged with the fixed member 3A and a disengaging position in which those members are disengaged from each other.

The connecting member 5A is formed by bending a metal plate, and includes a flat vertical plate portion 81 extending in the front-back direction, a flat top plate 82 bent to the left from the upper end of the vertical plate portion 81 and extending in the front-back direction, and a hanging plate 821 bent vertically downward from the left edge of the top plate 82. The vertical plate portion 81 includes three rectangular openings aligned in the front-back direction, which are a first window 811, a second window 812, and a third window 813. In addition, the vertical plate portion 81 includes a first guide opening 831 on the front side of the first window 811, and a second guide opening 832 between the second window 812 and the third window 813.

The first window 811 is for receiving the first lock portion 73 of the fixed member 3A, and the third window 813 is for receiving the second lock portion 74. When the post-processing apparatus 2 is placed beside the image forming apparatus 1, the first and second lock portions 73, 74 are respectively fitted in the first and third windows 811, 813 from the left. The second window 812 corresponds to the window 55 in the first embodiment, and serves to avoid interference between the positioning pin 33A and the connecting member 5A. The positioning pin 33A is inserted through the second window 812 into a long hole 243A having the major axis oriented vertically and formed in the vertical frame plate 24 of the post-processing apparatus 2.

The first window 811 includes a first engaging lug 84 formed along the front edge thereof, so as to intrude in the first slit 732. Likewise, the third window 813 includes a second engaging lug 85 formed along the front edge thereof, so as to intrude in the second slit 742. The first and second engaging lugs 84, 85 are formed by perpendicularly bending the lug portion to the right from the front edge of the first and third windows 811, 813, respectively, into an elongate shape extending in the up-down direction. The widths of the first and second engaging lugs 84, 85 in the left-right direction are narrower than the widths of the first and second slits 732, 742 in the left-right direction.

The first window 811 includes a first abutment lug 861 formed along the upper edge thereof, and the third window 813 includes a second abutment lug 862 formed along the upper edge thereof. The first and second abutment lugs 861, 862 are formed by perpendicularly bending the lug portion to the right from the upper edge of the first and third windows 811, 813 (see FIG. 20). The respective projecting ends (on the right) of the first and second abutment lugs 861, 862 are abutted to the left face of the vertical plate portion 71 of the fixed member 3A, when the post-processing apparatus 2 is placed beside the image forming apparatus 1, i.e., when the fixed member 3A is opposed to the connecting member 5A (FIG. 21). More specifically, the first abutment lug 861 is abutted to a region upper than the first opening 711 of the vertical plate portion 71, and the second abutment lug 862 is abutted to a region upper than the third opening 713 of the vertical plate portion 71. Such abutment allows the first and second slits 732, 742 and the first and second engaging lugs 84, 85 to be respectively positioned with each other, thereby enabling the first and second engaging lugs 84, 85 to intrude in the first and second slits 732, 742, respectively.

The first guide opening 831 and the second guide opening 832 are linear elongate openings extending in the front-back direction. A first guide screw 241A and a second guide screw 242A are fastened to the vertical frame plate 24A through the first guide opening 831 and the second guide opening 832, respectively. These components correspond to the first and second guide openings 53, 54 and the first and second guide screws 241, 242 in the first embodiment. A difference from the first embodiment lies in that the first and second guide openings 831, 832 linearly extend in the front-back direction, and that the connecting member 5A guided by the first and second guide openings 831, 832 is restricted from moving in the up-down direction and only allowed to move in the front-back direction. Such a configuration allows the connecting member 5A to be formed in a smaller size, to the extent corresponding to the displacement in the up-down direction.

The front portion 81F of the vertical plate portion 81 sticks out forward from the front vertical frame 250F, when the connecting member 5A is set to the disengaging position. The front portion 81F includes a bent portion 814 bent to the left from the front end thereof, and a projection 815 bent backward from the left end of the bent portion 814. The user can hold the bent portion 814 to displace the connecting member 5A, either by pressing backward or pulling forward.

The vertical plate portion 81 includes a connector holding base 87 located in the rear portion thereof and wider in the up-down direction than the remaining portions of the vertical plate portion 81. A retention member 66 that holds the second connector 6A is attached to the connector holding base 87, so as to move in the up-down direction with respect to the connecting member 5A. As shown in FIG. 18, the retention member 66 is retained so as to move in the up-down direction by four guide lugs 871, 872, 873, 874 provided on the connector holding base 87, at upper and lower positions on the rear side and upper and lower positions on the front side, respectively.

The connector holding base 87 includes, as shown in FIG. 19, a pair of long holes 875, 876 having the major axis oriented vertically and aligned in the up-down direction. The retention member 66 include a guide pin 67 projecting to the right through the upper long hole 875, and a projection 68 to be guided by the lower long hole 876. The retention member 66 corresponds to the retention member 56, and the guide pin 67 corresponds to the guide pin 564 in the first embodiment. The guide pin 67 is introduced in the guide space 34AG in the guide unit 34A of the fixed member 3A, so as to adjust the height level of the retention member 66 (second connector 6A). The retention member 66 can be displaced in the up-down direction within a range between an upper limit where the guide pin 67 abuts against the upper edge of the upper long hole 875 and a lower limit where the projection 68 abuts against the lower edge of the lower long hole 876.

The second connector 6A is similar to the second connector 6 in the first embodiment, and is electrically connected to the post processing unit 200 in the post-processing apparatus 2 via the second cable 6C.

The second connector 6A includes nail portions 651, 652 that hold the second connector 6A. The second connector 6A is slightly movable in the up-down direction and the left-right direction, retained by the nail portions 651, 652. Accordingly, even when the connector opening 63A of the second connector 6A and the connector opening 43A of the first connector 4A are slightly deviated from each other, such deviation can be absorbed by the mobility of the second connector 6A, and therefore the connectors can be fitted with each other.

Figure 22:
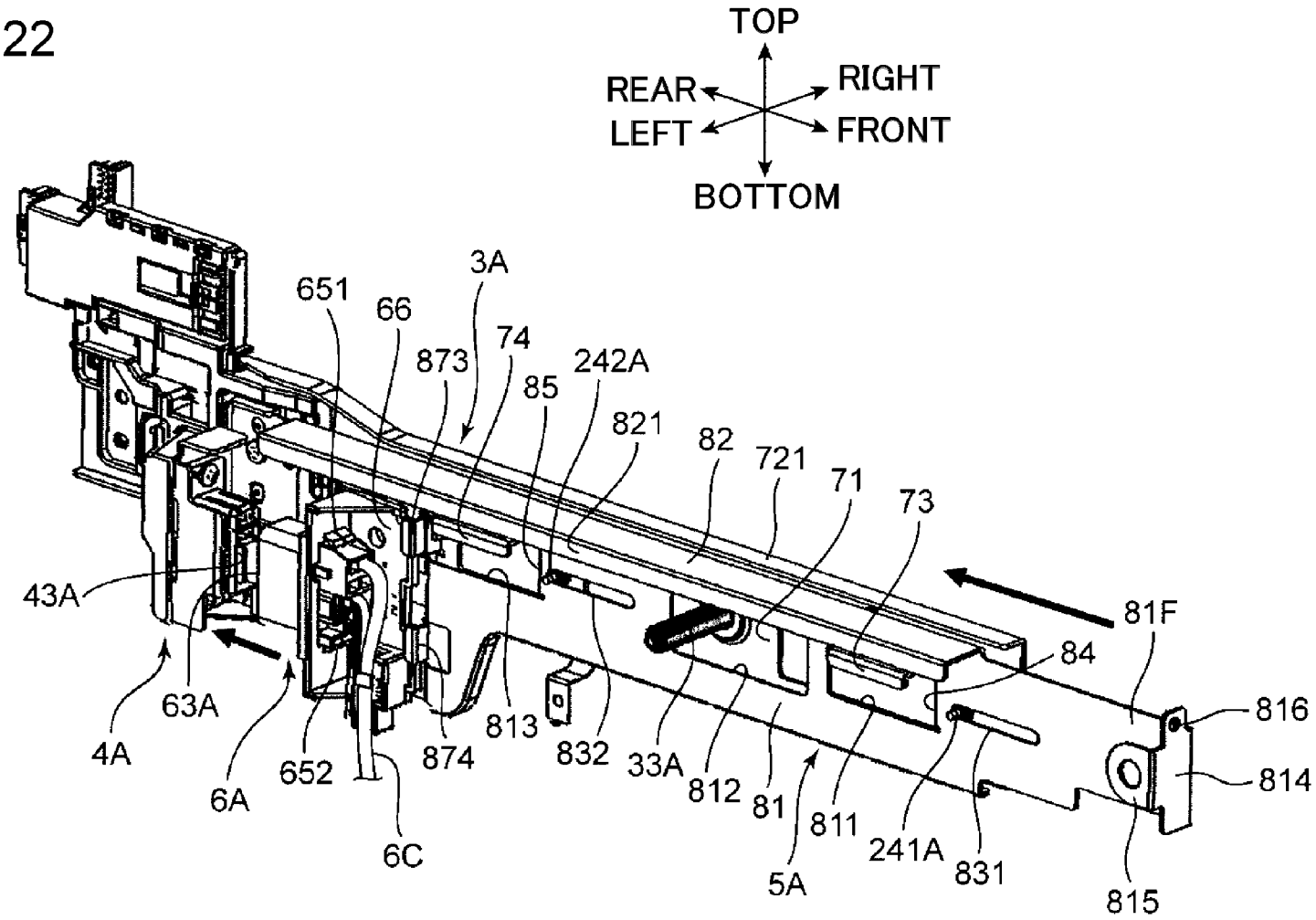
FIG. 22 is a fragmentary perspective view for explaining the engagement between the fixed member and the connecting member in a left-right direction, in which the connecting member is set to the disengaging position.
Figure 23:
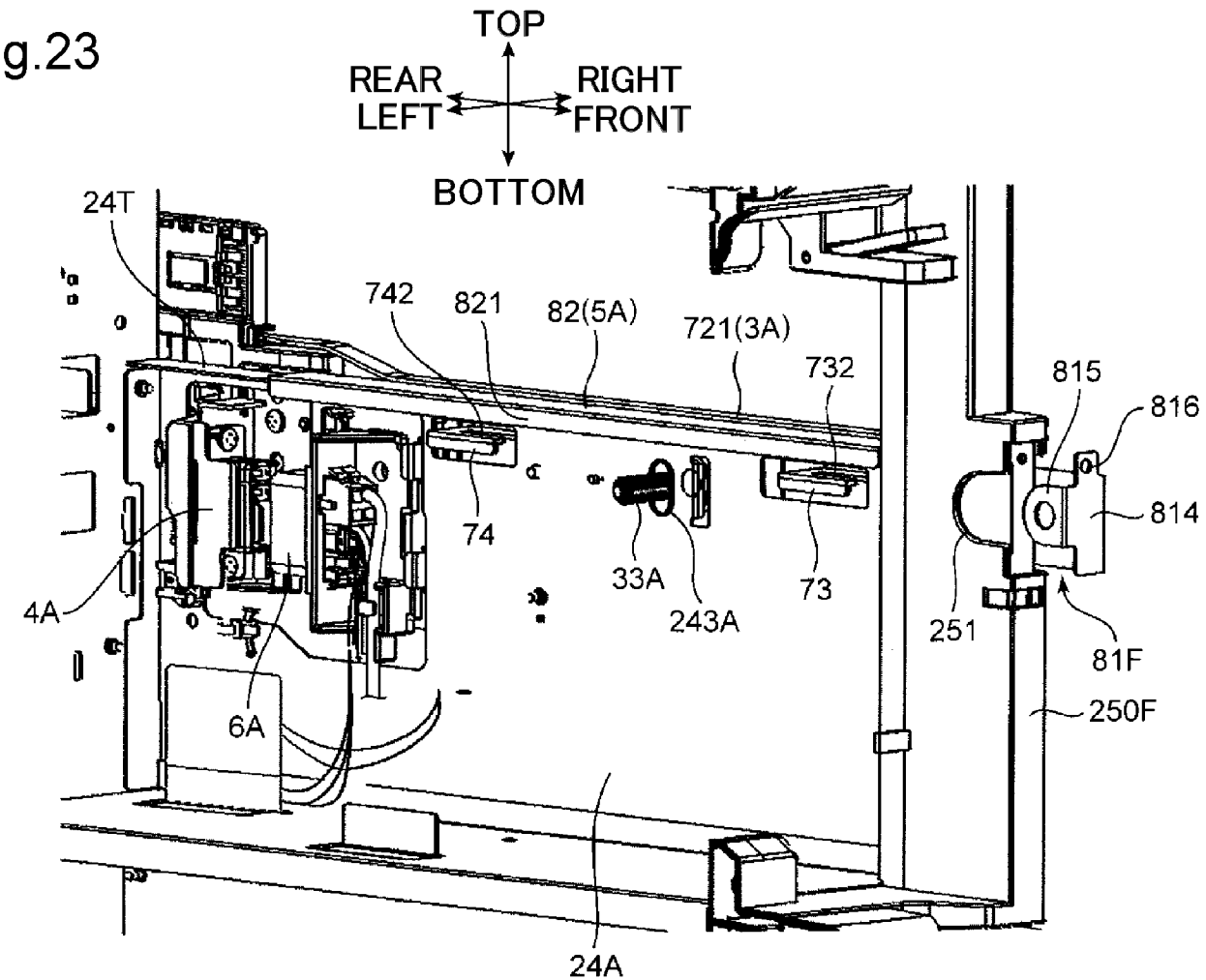
FIG. 23 is a fragmentary perspective view showing the fixed member and the connecting member engaged as shown in FIG. 22 and attached to a vertical frame plate of the post-processing apparatus.

Hereunder, the engagement between the fixed member 3A and the connecting member 5A will be described. FIG. 22 is a perspective view showing the connecting member 5A set to the disengaging position, and FIG. 23 is a perspective view showing the connecting member 5A shown in FIG. 22 attached to the vertical frame plate 24A of the post-processing apparatus 2. FIGS. 22 and 23 illustrate the state immediately before the post-processing apparatus 2 is mechanically connected to the image forming apparatus 1, or immediately after the connection is cancelled.

The connecting member 5A and the fixed member 3A are disposed such that the vertical plate portion 81 and the vertical plate portion 71 are closely opposed to each other in parallel, and that the top plate 82 and the horizontal plate portion 721 are aligned in the left-right direction at generally the same height level. The first and second lock portions 73, 74 of the fixed member 3A are respectively fitted in the first and third windows 811, 813 of the connecting member 5A. Although not shown, the first and second abutment lugs 861, 862 of the connecting member 5A are abutted to the left face of the vertical plate portion 71 of the fixed member 3A. Such engagement allows the first and second slits 732, 742 and the first and second engaging lugs 84, 85 to be respectively positioned with each other.

When the connecting member 5A is set to the disengaging position, the connecting member 5A is drawn out forward from the post-processing apparatus 2. At this point, the first and second engaging lugs 84, 85 are spaced from the first and second slits 732, 742 to the front side, and hence not engaged therewith. In other words, the connecting member 5A and the fixed member 3A are not mechanically connected to each other in the left-right direction via the first and second lock portions 73, 74. However, the first and second engaging lugs 84, 85 are respectively opposed to the front openings of the first and second slits 732, 742 in the front-back direction. The front portion 81F of the connecting member 5A is sticking out forward from the front vertical frame 250F. In the mentioned state, the first connector 4 and the second connector 6 are not fitted with each other and the connector openings 43A, 63A are opposed to each other.

Figure 24:
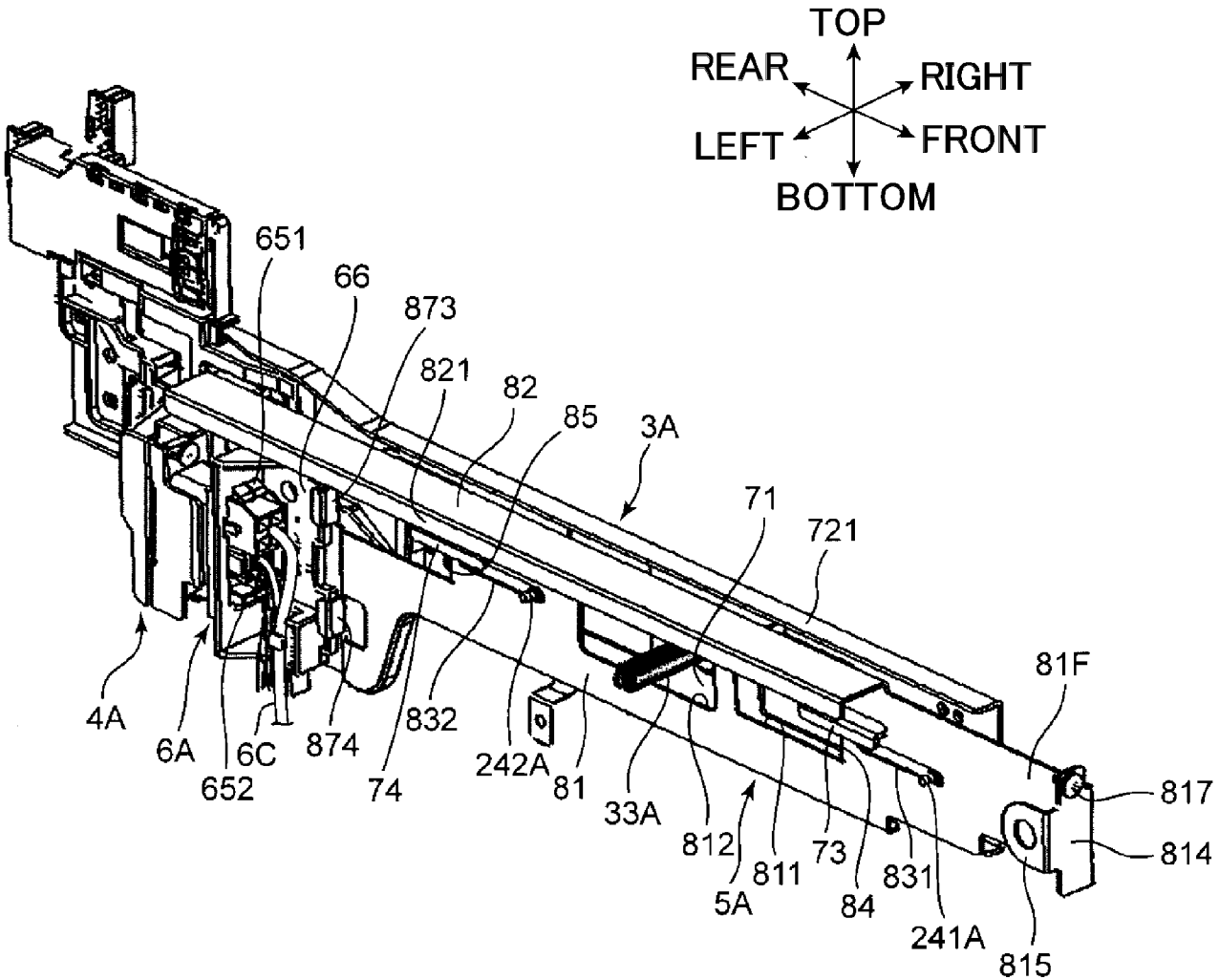
FIG. 24 is a fragmentary perspective view for explaining the engagement between the fixed member and the connecting member in a left-right direction, in which the connecting member is set to the engaging position.
Figure 25:
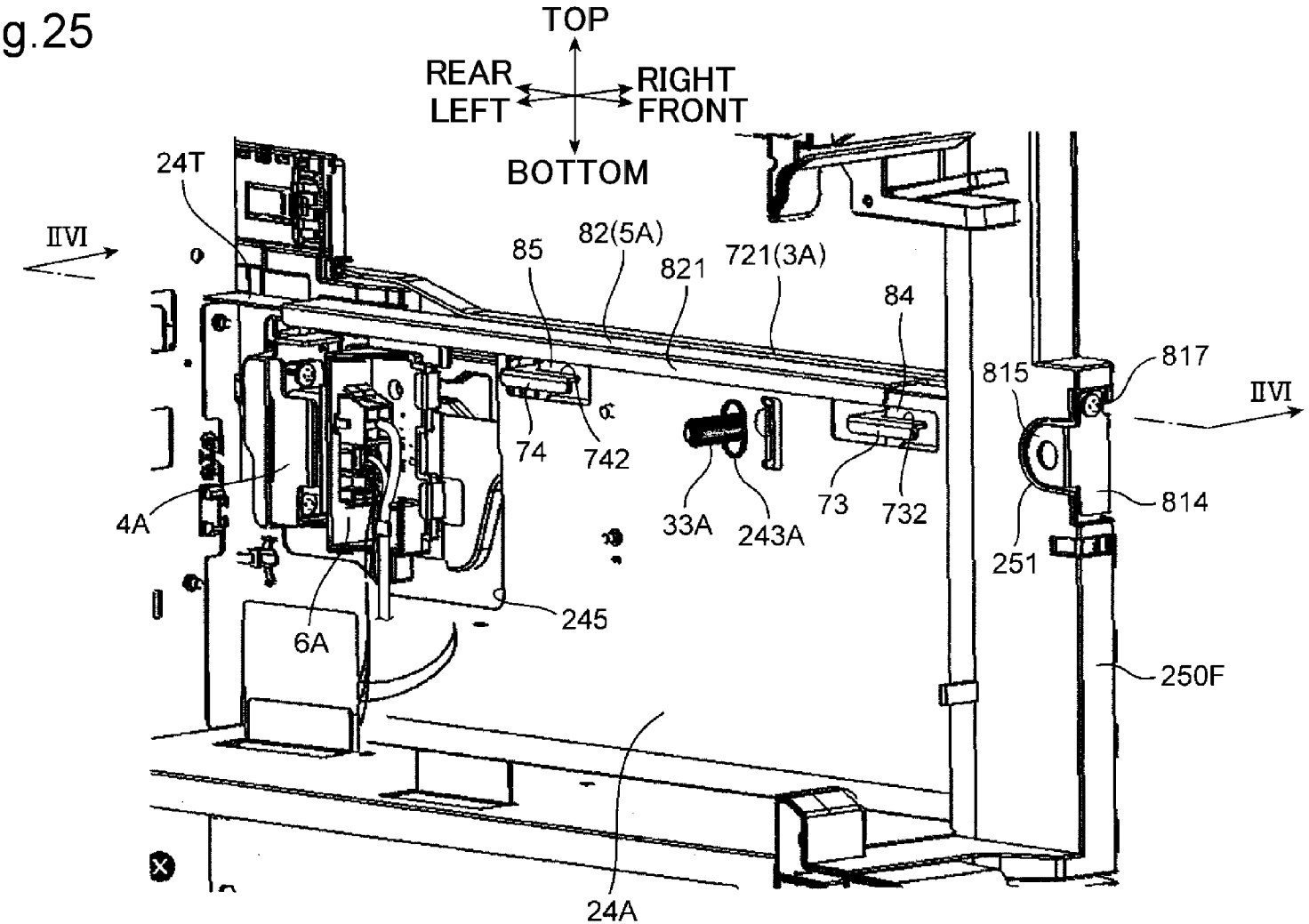
FIG. 25 is a fragmentary perspective view showing the fixed member and the connecting member engaged as shown in FIG. 24 and attached to the vertical frame plate of the post-processing apparatus.
Figure 26:
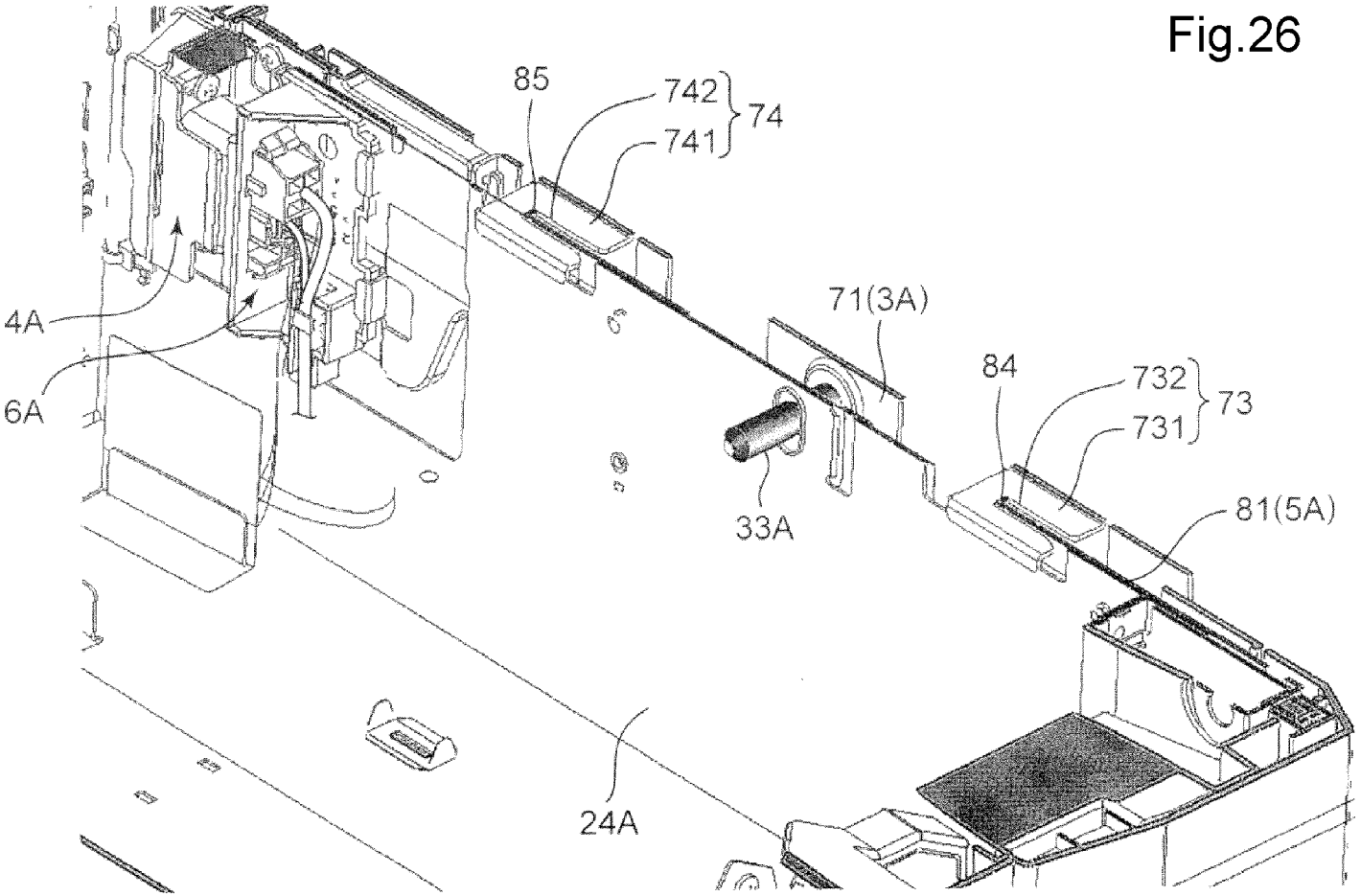
FIG. 26 is a perspective view from a cross-section taken along a line IIVI-IIVI in FIG. 25.

FIG. 24 is a perspective view showing the connecting member 5A set to the engaging position, FIG. 25 is a perspective view showing the connecting member 5A shown in FIG. 24 attached to the vertical frame plate 24A of the post-processing apparatus 2, and FIG. 26 is a perspective view from a cross-section taken along a line IIVI-IIVI in FIG. 25. While the connecting member 5A is being displaced from the disengaging position to the engaging position, the first and second guide openings 831, 832 are respectively guided by the first and second guide screws 241A, 242A so that the connecting member 5A is made to slide linearly backward. The first and second guide screws 241A, 242A respectively abutted to the rear edge of the first and second guide openings 831, 832 in the disengaging position are respectively made to abut against the front edge of the first and second guide openings 831, 832 in the engaging position.

The connecting member 5A is pressed backward from the forward position and placed inside the post-processing apparatus 2, when set to the engaging position. In this state, the first and second engaging lugs 84, 85 intrude in the first and second slits 732, 742, respectively. As a result, the first and second engaging lugs 84, 85 respectively interfere with the first and second plate-shaped lugs 731, 741 in the left-right direction thus to be engaged therewith. Thus, the connecting member 5A and the fixed member 3A are mechanically connected to each other in the left-right direction, via the first and second lock portions 73, 74.

When the connecting member 5A is set to the engaging position, the front portion 81F is located closely along the front vertical frame 250F. The bent portion 814 is set flush with the front face of the front vertical frame 250F, and the projection 815 is fitted in a recess 251 formed in the front vertical frame 250F. A screw 817 is fitted in a screw hole 816 (FIG. 22) of the bent portion 814.

Height level adjustment between the first connector 4A and the second connector 6A is performed by the guide unit 34A, while the connecting member 5A is being displaced from the disengaging position to the engaging position. When the connecting member 5A reaches the engaging position, the connector openings 43A, 63A are fitted with each other. The actions of the related components for such engagement are the same as those described in the first embodiment with reference to FIGS. 11 to 16, and therefore the description will not be repeated.

The configuration according to the second embodiment, the interference with the first and second lock portions 73, 74 and the cancellation thereof, which creates the state where the image forming apparatus 1 and the post-processing apparatus 2 are mechanically connected and the state where the apparatuses 1 and 2 are released from the mechanical connection, can be achieved simply by displacing the connecting member 5A in the front-back direction. Thus, the apparatuses 1 and 2 can be mechanically connected and disconnected with a simplified mechanism. In addition, the connecting member 5A can be formed in a smaller size to the extent corresponding to the displacement in the up-down direction. Further, the mechanical connection between the image forming apparatus 1 and the post-processing apparatus 2 can be securely achieved, with a simple operation of inserting and removing the first and second engaging lugs 84, 85 in and from the first and second slits 732, 742.

Although the embodiments of the disclosure have been described in details as above, the disclosure is in no way limited to the foregoing embodiments, and various modifications may be made, a few examples of which will be cited hereunder.

(1) In the foregoing embodiments, the combined units according to the disclosure are exemplified by the image forming system S composed of the image forming apparatus 1 and the post-processing apparatus 2 coupled together. Alternatively, the disclosure may be applied to combined units including the image forming apparatus 1 and an additional paper feed unit that supplies the sheets to the image forming apparatus 1. Further, without limitation to the field of the image forming apparatus, the disclosure may be applied to combined units including a first unit including an electric device configured to perform a certain function and a second unit including another type of electric device.

(2) In the first embodiment, the fixed member 3 and the connecting member 5 are engaged with each other through the interference between the lock portion 321 and the hanging plate 521. In the second embodiment, the fixed member 3A and the connecting member 5A are engaged with each other by the intrusion of the first and second engaging lugs 84, 85 into the first and second slits 732, 742. However, the fixed member and the connecting member may be engaged in any desired manner, provided that the engagement and disengagement can be achieved by the displacement of the connecting member in the front-back direction (second direction). For example, engagement between a recess and a protrusion or between a hole and a hook may be adopted for causing the fixed member and the connecting member 5 to be engaged with each other. However, from the viewpoint of stable and secure mechanical connection, it is preferable to adopt a configuration that causes flat plate members to interfere with each other, such as the lock portion 321 and the hanging plate 521.

(3) In the foregoing embodiments, the positioning pin 33 on the side of the image forming apparatus 1 is inserted in long hole 243 on the side of the post-processing apparatus 2. However, in the case where there is no likelihood at all that a height level difference is produced between the image forming apparatus 1 and the post-processing apparatus 2, a circular hole of a size corresponding to the outer diameter of the positioning pin 33 may be provided on the side of the post-processing apparatus 2, in place of the long hole 243. In this case, the height level alignment between the first connector 4 and the second connector 6 can be achieved upon inserting the positioning pin 33 in the circular hole, and therefore the retention member 56 may be fixed to the vertical plate portion 51. In addition, it becomes unnecessary to provide the guide unit 34 on the fixed member 3.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. Combined units comprising:

a first unit having a first side face and including therein a first electric device;

a second unit having a second side face and including therein a second electric device, the second unit being installed beside the first unit, with the second side face opposed to the first side face;

a fixed member disposed on the first side face in a fixed manner;

a first connector disposed on the first side face in a fixed manner and electrically connected to the first electric device;

a connecting member disposed on the second side face so as to move in a front-back direction of the first unit while being restricted from moving in an up-down direction and configured so as to be displaced, by moving in the front-back direction, between an engaging position in which the connecting member is engaged with the fixed member to keep the first unit and the second unit from being separated from each other in a left-right direction orthogonal to the front-back direction and a disengaging position in which the connecting member is disengaged from the fixed member; and a second connector mounted on the connecting member and configured so as to be displaced in the front-back direction according to the displacement of the connecting member in the front-back direction and, with the connecting member engaged with the fixed member, connect to the first connector to electrically connect the first unit to the second electric device, wherein the fixed member includes a lock portion for achieving the engagement, the lock portion being disposed so as to interfere in the left-right direction with a part of the connecting member set to the engaging position thus to be engaged with the connecting member, but not to interfere with the connecting member set to the disengaging position, the first connector and the second connector are disconnected from each other when the connecting member is set to the disengaging position in a state where the first and second units are aligned to closely oppose the fixed member to the connecting member, and the first connector and the second connector are connected to each other when the connecting member is set to the engaging position.

2. Combined units comprising:

a first unit having a first side face and including therein a first electric device;

a second unit having a second side face and including therein a second electric device, the second unit being installed beside the first unit, with the second side face opposed to the first side face;

a fixed member disposed on the first side face in a fixed manner;

a first connector disposed on the first side face in a fixed manner and electrically connected to the first electric device;

a connecting member disposed on the second side face so as to move in a front-back direction of the first unit, and configured so as to be displaced, by moving in the front-back direction, between an engaging position in which the connecting member is engaged with the fixed member to keep the first unit and the second unit from separating from each other in a left-right direction orthogonal to the front-back direction and a disengaging position which is located at a height level different in the up-down direction from the engaging position and in which the connecting member is disengaged from the fixed member; and a second connector mounted on the connecting member and configured so as to be displaced in the front-back direction according to the displacement of the connecting member in the front-back direction and, with the connecting member engaged with the fixed member, connect to the first connector to electrically connect the first unit to the second electric device, wherein the fixed member includes a lock portion for achieving the engagement, the lock portion being disposed so as to interfere in the left-right direction with a part of the connecting member set to the height level corresponding to the engaging position thus to be engaged with the connecting member, but not to interfere with the connecting member set to the height level corresponding to the disengaging position, the first connector and the second connector are disconnected from each other when the connecting member is set to the disengaging position in a state where the first and second units are aligned to closely oppose the fixed member to the connecting member, and the first connector and the second connector are connected to each other when the connecting member is set to the engaging position.

3. The combined units according to claim 1, wherein the lock portion includes a plate-shaped lug extending in the left-right first direction, and a slit formed in the plate-shaped lug so as to extend in the front-back direction, and the connecting member includes an engaging lug formed so as to intrude in the slit, the engaging lug being configured to:

be spaced from the slit when the connecting member is set to the disengaging position; and intrude in the slit when the connecting member is set to the engaging position to thereby interfere with the plate-shaped lug.

4. The combined units according to claim 1, wherein the connecting member includes a retention member that retains the second connector and is movable in an up-down direction with respect to the connecting member, the up-down direction being orthogonal to the left-right direction in a vertical plane, the fixed member includes a guide unit extending in the front-back direction and configured to guide the second connector to a position to be fitted with the first connector, and the guide unit is configured to guide a part of the retention member so as to adjust a height level of the second connector with respect to the first connector into a predetermined tolerance, while the connecting member is being displaced from the disengaging position to the engaging position.

5. The combined units according to claim 4, wherein the part of the retention member to be guided is a guide pin projecting in the left-right direction from the retention member, and the guide unit includes a tapered guide surface that can be contacted by the guide pin, the guide surface having a width reducing in the direction to guide the second connector to the position to be fitted with the first connector.

6. The combined units according to claim 1, wherein the first side face includes a positioning pin projecting in the left-right direction, the second side face includes a frame member having a hole in which the positioning pin is to be inserted, and the connecting member is displaced after the positioning pin is inserted in the hole, and includes a window that avoids interference with the positioning pin when the connecting member is displaced.

7. The combined units according to claim 4, wherein the first side face includes a circular column-shaped positioning pin projecting in the left-right direction, the second side face includes a frame member having a long hole in which the positioning pin is to be inserted, the long hole extends in the up-down direction, the connecting member is displaced after the positioning pin is inserted in the long hole, and includes a window that avoids interference with the positioning pin when the connecting member is displaced, and a movable range of the retention member in the up-down direction is determined according to a stroke range of the positioning pin within the long hole.

8. The combined units according to claim 1, wherein the first unit and the second unit each include a front face opposed to a user operating the unit, and the connecting member is drawn out from the front face toward the user when the connecting member is set to the disengaging position, and accommodated inside the second unit when the connecting member is set to the engaging position.

9. The combined units according to claim 1, wherein the first connector and the second connector are preliminarily positioned with respect to each other while the connecting member is being displaced from the disengaging position toward the engaging position, and the first connector and the second connector are fitted with each other by further displacement of the connecting member in the front-back direction.

10. An image forming system comprising:

an image forming apparatus having a first side face and configured to form an image on a sheet using a first electric device included in the image forming apparatus;

a post-processing apparatus having a second side face and including therein a second electric device that performs a predetermined post processing on the sheet on which the image has been formed, the post-processing apparatus being configured to perform the post processing upon being installed beside the image forming apparatus with the second side face closely opposed to the first side face;

a fixed member disposed on the first side face in a fixed manner;

a first connector disposed on the first side face in a fixed manner and electrically connected to the first electric device;

a connecting member disposed on the second side face so as to move in a front-back direction of the image forming apparatus while being restricted from moving in an up-down direction, and configured so as to be displaced, by moving in the front-back direction, between an engaging position in which the connecting member is engaged with the fixed member to keep the image forming apparatus and the post-processing apparatus from being separated from each other in a left-right direction orthogonal to the front-back direction and a disengaging position in which the connecting member is disengaged from the fixed member; and a second connector mounted on the connecting member and configured so as to be displaced in the front-back direction according to the displacement of the connecting member in the front-back direction and, with the connecting member engaged with the fixed member, connect to the first connector to electrically connect the image forming apparatus to the second electric device, wherein the fixed member includes a lock portion for achieving the engagement, the lock portion being disposed so as to interfere in the left-right direction with a part of the connecting member set to the engaging position thus to be engaged with the connecting member, but not to interfere with the connecting member set to the disengaging position, the first connector and the second connector are disconnected from each other when the connecting member is set to the disengaging position in a state where the image forming apparatus and the post-processing apparatus are aligned to closely oppose the fixed member to the connecting member, and the first connector and the second connector are connected to each other when the connecting member is set to the engaging position.

* * * * *